US008310440B2

(12) United States Patent
Miyasaka et al.

(10) Patent No.: US 8,310,440 B2
(45) Date of Patent: Nov. 13, 2012

(54) METHOD OF DRIVING ELECTROPHORETIC DISPLAY DEVICE, ELECTROPHORETIC DISPLAY DEVICE, AND ELECTRONIC APPARATUS

(75) Inventors: Eiji Miyasaka, Suwa (JP); Katsutoyo Inoue, Matsumoto (JP); Yuko Komatsu, Suwa (JP)

(73) Assignee: Seiko Epson Corporation (JP)

( * ) Notice: Subject to any disclaimer, the term of this patent is extended or adjusted under 35 U.S.C. 154(b) by 539 days.

(21) Appl. No.: 12/555,048

(22) Filed: Sep. 8, 2009

(65) Prior Publication Data

US 2010/0118046 A1 May 13, 2010

(30) Foreign Application Priority Data

Nov. 10, 2008 (JP) ..... 2008-287713
Nov. 10, 2008 (JP) ..... 2008-287714
Mar. 11, 2009 (JP) ..... 2009-058068

(51) Int. Cl.
*G09G 3/34* (2006.01)

(52) U.S. Cl. ..... 345/107

(58) Field of Classification Search ..... 345/107
See application file for complete search history.

(56) References Cited

U.S. PATENT DOCUMENTS

2006/0209011 A1* 9/2006 Miyasaka ..... 345/107
2007/0080926 A1 4/2007 Zhou et al.
2008/0238867 A1* 10/2008 Maeda et al. ..... 345/107
2008/0284768 A1* 11/2008 Yoshida et al. ..... 345/208

FOREIGN PATENT DOCUMENTS

JP 2007-512571 5/2007
JP 2007-206267 8/2007

* cited by examiner

*Primary Examiner* — Adam R Giesy
(74) *Attorney, Agent, or Firm* — Harness, Dickey & Pierce, P.L.C.

(57) ABSTRACT

There is provided a method of driving an electrophoretic display device including a display unit that has a plurality of pixels and an electrophoretic element disposed between substrates forming one pair. The method includes setting an area that at least includes a pixel forming an image component that is formed to have a first gray scale and a pixel that is disposed to be adjacent to the pixel forming the contour of the image component and represents a second gray scale as an image removing area and selectively changing the pixels that constitute the image removing area to have the second gray scale.

7 Claims, 26 Drawing Sheets

FIG. 5A
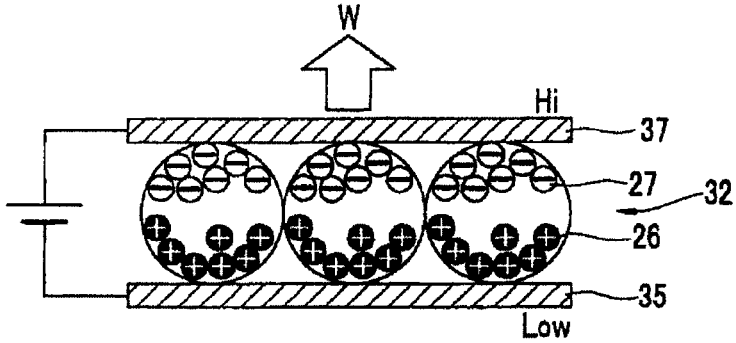
FIG. 5B
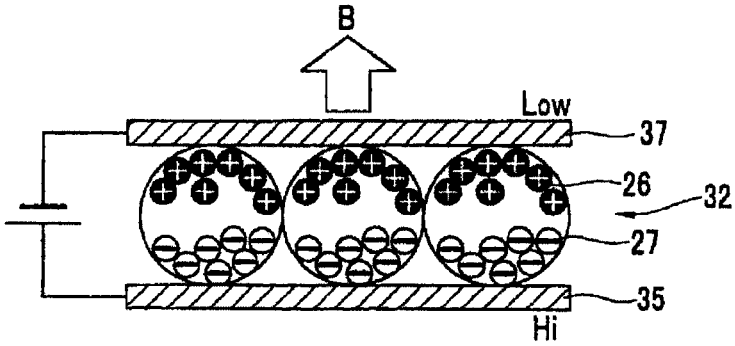
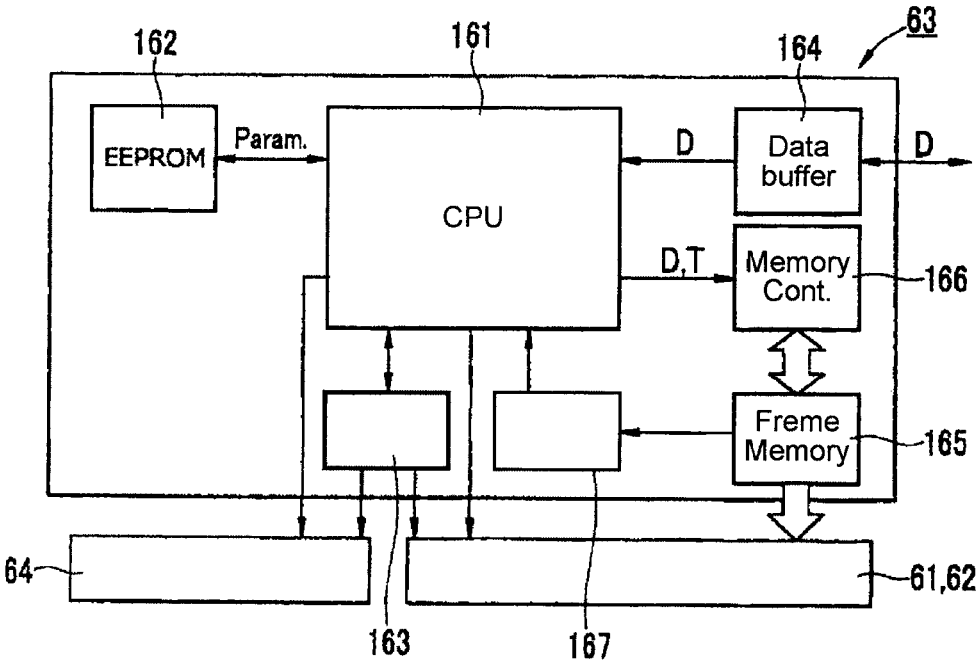
FIG. 6

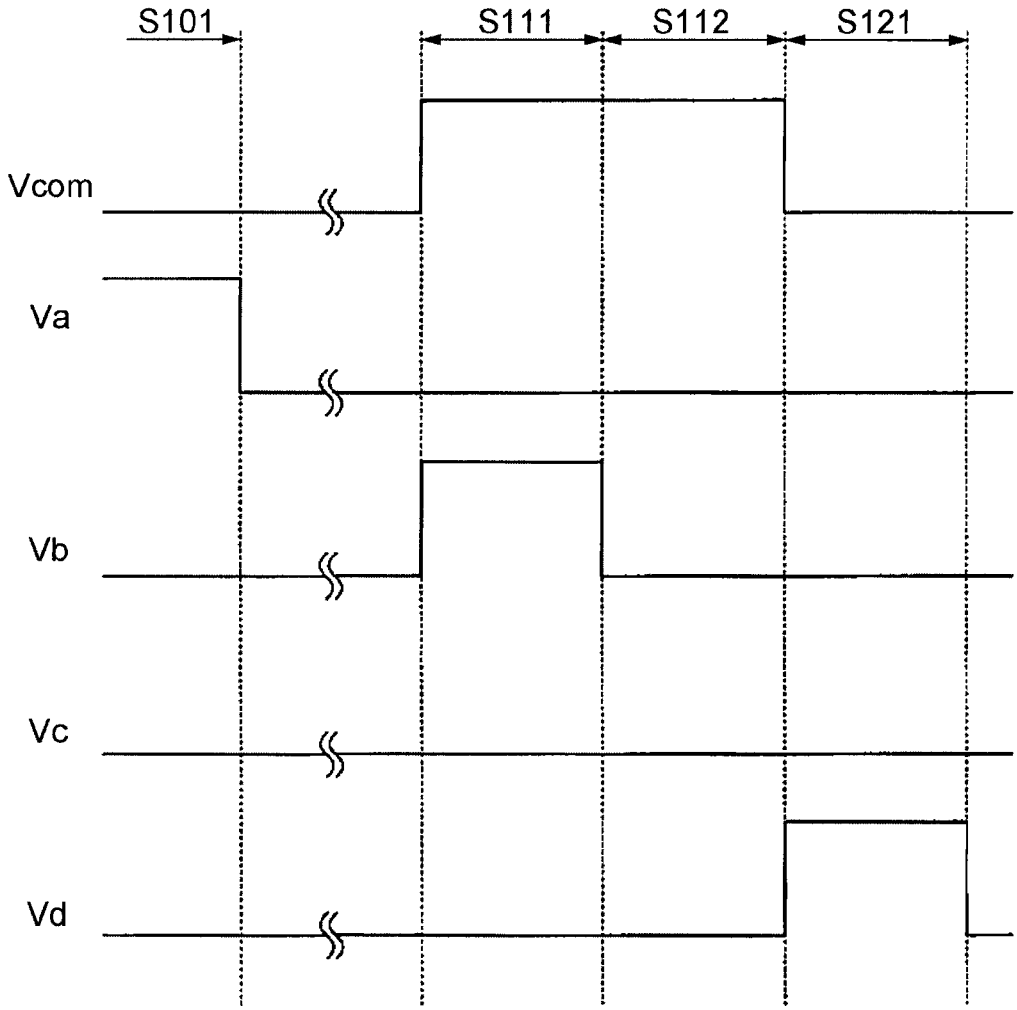
FIG.19
FIG.20
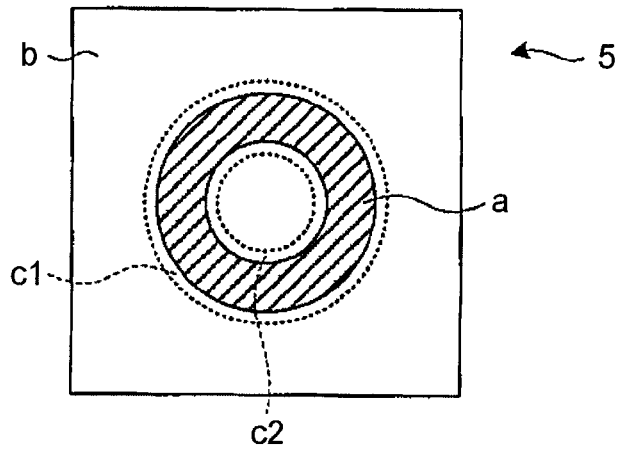

METHOD OF DRIVING ELECTROPHORETIC DISPLAY DEVICE, ELECTROPHORETIC DISPLAY DEVICE, AND ELECTRONIC APPARATUS

CROSS REFERENCES TO RELATED APPLICATIONS

The present invention contains subject matter related to Japanese Patent Application No. 2008-287713 and Japanese Patent Application No. 2008-287714 filed in the Japanese Patent Office on Nov. 10, 2008 and Japanese Patent Application No. 2009-058068 filed in the Japanese Patent Office on Mar. 11, 2009, the entire contents of which are incorporated herein by reference.

BACKGROUND

1. Technical Field

The present invention relates to a method of driving an electrophoretic display device, an electrophoretic display device, and an electronic apparatus.

2. Related Art

For example, in JP-A-2007-206267, an electrophoretic display device, in which a voltage is not applied between a pixel electrode and a common electrode corresponding to a white display area of the first image but is applied only between a pixel electrode and a common electrode corresponding to a black display area (image component) for inverting the area so as to be removed as an entirely white display when an image displayed in a display unit is rewritten from the first image to the second image, has been disclosed.

When the image removal is performed by only driving pixels that form the image component as described above, it has been known that a thin afterimage is generated along the contour of the image component. In other words, occurrence of a burn-in phenomenon in a boundary portion of the image has been known. Such an afterimage is generated since an image of which the contour portion is raised is displayed due to generation of an electric field formed in the diagonal direction that crosses a pixel forming the contour and a pixel forming the background at the time of displaying an image.

Thus, a driving method in which an image is removed by performing image removal in all the pixels including pixels of which gray scales are not to be changed for preventing an afterimage of the previous image from remaining when the image is updated has been disclosed, for example, in JP-T-2007-512571.

However, in such a driving method, the electrophoretic particles are driven such that the final display gray scale is not changed also for the pixels of which the display is not changed. Accordingly, the electrophoretic particles are driven in the same manner as the entire display unit is rewritten, and there is a problem that the power consumption for updating an image increases.

SUMMARY

An advantage of some aspects of the invention is that it provides a method of driving an electrophoretic display device, an electrophoretic display device, and an electronic apparatus that can remove an image without generating an afterimage (burn-in phenomenon) while suppressing the power consumption.

According to a first aspect of the invention, there is provided a method of driving an electrophoretic display device having a display unit that is formed of a plurality of pixels by pinching an electrophoretic element including electrophoretic particles between substrates forming one pair. The method includes setting an area that at least includes a pixel forming an image component that is formed to have a first gray scale and a pixel that is disposed to be adjacent to the pixel forming the contour of the image component and represents a second gray scale as an image removing area based on an image signal of an image that is displayed in the display unit and selectively changing the pixels that constitute the image removing area to have the second gray scale.

According to the above-described driving method, only the pixels that constitute the image removing area that is set broader than the image component are driven in the setting of the area and selectively changing of the pixels. Accordingly, the image can be removed without generating an afterimage (burn-in phenomenon) while suppressing the power consumption.

According to a second aspect of the invention, there is provided a method of driving an electrophoretic display device having a display unit that is formed of a plurality of pixels by pinching an electrophoretic element including electrophoretic particles between substrates forming one pair. The method includes: selectively changing a pixel that forms an image component formed to have a first gray scale to have a second gray scale based on an image signal of an image that is displayed in the display unit; and removing the image. The removal of the image includes setting an area that at least includes a pixel that forms the contour of the image component and a pixel that is disposed to be adjacent to the pixel that forms the contour and represents the second gray scale, as an afterimage removing area and selectively changing the pixels that constitute the afterimage removing area to have the second gray scale.

According to the above-described driving method, only the pixels that constitute the afterimage removing area are driven in the setting of the area as the afterimage removing area and selectively change the afterimage removing area, and accordingly, the afterimage can be removed while suppressing the power consumption. In addition, only the pixels forming the image component are driven in the selective changing of the pixel, and accordingly, an image can be removed while suppressing the power consumption. As a result, the power consumption in the removing of the image can be suppressed.

In the above-described method, it is preferable that the image removing area is set as the pixel that forms the image component and the pixel that is disposed to be adjacent to a pixel that forms the contour of the image component and represents the second gray scale.

In such a case, the image displaying area that is formed by the image component and a band-shaped area corresponding to one pixel which frames the contour of the image is set as the image removing area. Accordingly, only a minimum number of the pixels are driven in the setting of the area as the image removing area and changing of the pixels. As a result, the image can be removed without generating any afterimage while suppressing the power consumption further.

In the above-described method, it is preferable that a value acquired by multiplying a voltage applied to the electrophoretic element by a time interval of the application of the voltage in the setting of the area and selectively changing the pixels to have the second gray scale is set to be smaller than a value acquired by multiplying a voltage applied to the electrophoretic element and a time interval of application of the voltage in the setting of the area as the image removing area and selectively changing the pixels to have the second gray scale.

In such a case, the load of the electrophoretic element can be suppressed in the setting of the area as the afterimage removing area and selectively changing the pixels. Accordingly, the balance of the electric potential of the electrophoretic element over the entire area of the display unit can be maintained to be approximately uniform. As a result, generation of unevenness in the displayed image can be prevented.

According to a third aspect of the invention, there is provided an electrophoretic display device including: a display unit that is formed of a plurality of pixels by pinching an electrophoretic element including electrophoretic particles between substrates forming one pair; and a control unit that controls the display unit. The control unit sets an area that at least includes a pixel forming an image component that is formed to have a first gray scale and a pixel that is disposed to be adjacent to a pixel forming the contour of the image component and represents a second gray scale as an image removing area based on an image signal of an image that is displayed in the display unit and selectively changes the pixels that constitute the image removing area to have the second gray scale, when an image of the display unit is to be removed.

According to the above-described electrophoretic display device, only the pixels that constitute the image removing area that is set broader than the image component are driven when the image is removed. Accordingly, an electrophoretic display device, which can remove the image without generating an afterimage while suppressing the power consumption, can be provided.

In the above-described electrophoretic display device, it is preferable that the image removing area is set as the pixel that forms the image component and the pixel that is disposed to be adjacent to a pixel that forms the contour of the image component and represents the second gray scale.

In such a case, by setting the image displaying area that is formed by the image component and a band-shaped area corresponding to one pixel which frames the contour of the image as the image removing area, only a minimum number of the pixels are driven for removing the image. As a result, an electrophoretic display device, which can remove the image without generating any afterimage while suppressing the power consumption further, can be provided.

According to a fourth aspect of the invention, there is provided an electronic apparatus that includes the above-described electrophoretic display device.

According to the above-described electronic apparatus, only the pixels that constitute the image removing area that is set broader than the image component are driven when the image is removed. Accordingly, an electronic apparatus, which can remove the image without generating an afterimage while suppressing the power consumption, can be provided.

BRIEF DESCRIPTION OF THE DRAWINGS

The invention will be described with reference to the accompanying drawings, wherein like numbers reference like elements.

FIGS. 5A and 5B are explanatory diagrams of the operation of the electrophoretic element.

FIG. 6 is a block diagram showing the details of a controller.

FIG. 19 is a timing chart relating to the image update.

FIG. 20 is a diagram showing an example of an image that is displayed in a display unit.

DESCRIPTION OF EXEMPLARY EMBODIMENTS

First Embodiment

Figure 1:
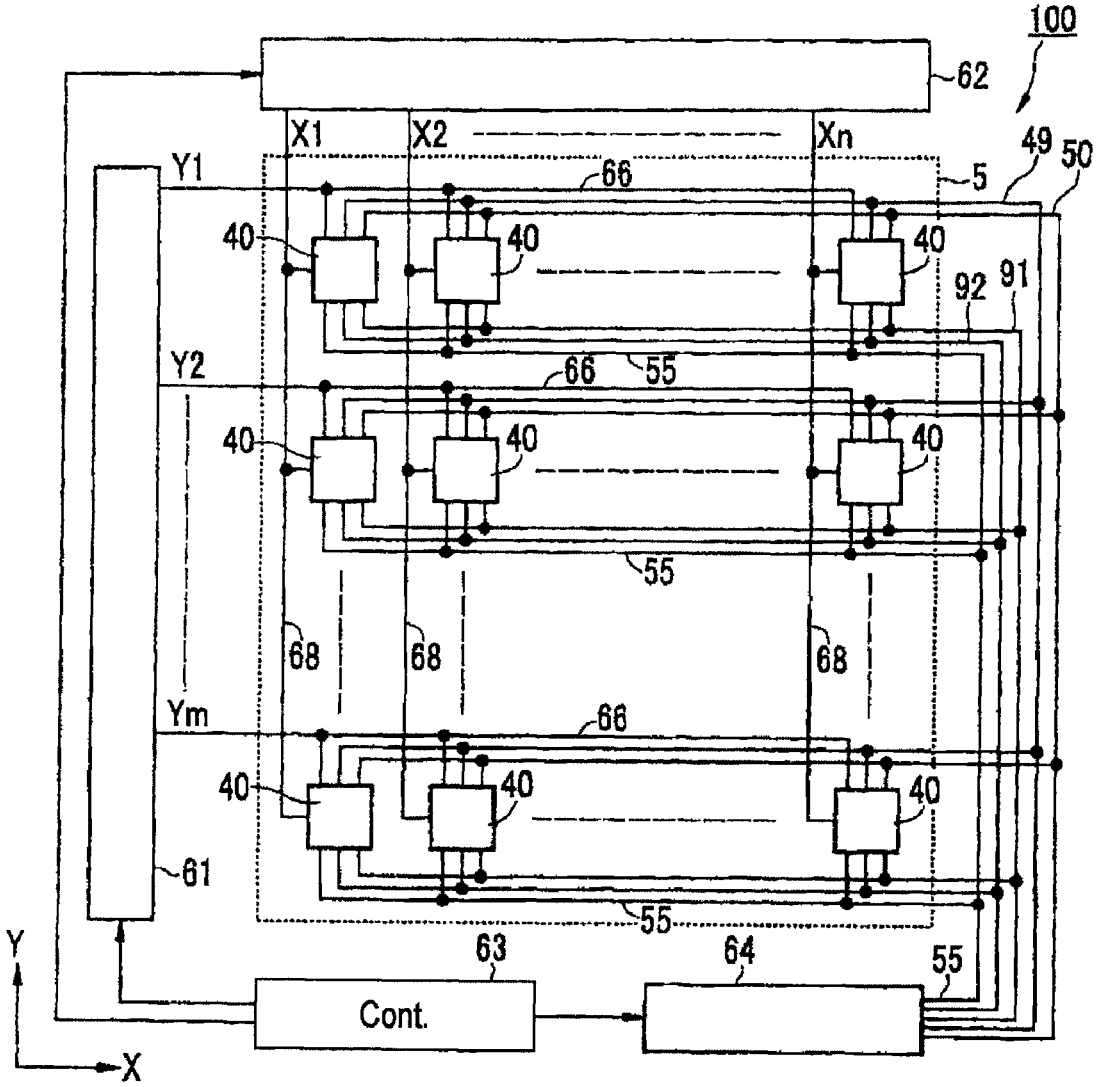
FIG. 1 is a schematic diagram showing the configuration of an electrophoretic display device according to a first embodiment of the invention.

Hereinafter, an electrophoretic display device according to a first embodiment of the invention will be described with reference to the accompanying drawings. In this embodiment, an electrophoretic display device that is driven in an active matrix mode will be described. This embodiment represents one embodiment of the invention. Thus, this embodiment does not limit the scope of the invention and may be arbitrarily changed within the scope of the technical idea of the invention. In the drawings below, the scale or the number of each structure is different from that of the actual structure for ease of understanding of each configuration.

Configuration of Electrophoretic Display Device

FIG. 1 is a schematic diagram showing the configuration of an active matrix driving-type electrophoretic display device 100 according to an embodiment of the invention.

The electrophoretic display device 100 includes a display unit 5 in which a plurality of pixels 40 is arranged. In the vicinity of the display unit 5, a scanning line driving circuit 61, a data line driving circuit 62, a controller (control unit) 63, and a common power source modulating circuit 64 are disposed. The scanning line driving circuit 61, the data line driving circuit 62, and the common power source modulating circuit 64 are connected to the controller 63. The controller 63 comprehensively controls the above-described members based on image signal and a synchronization signal that are supplied from an upper-level apparatus.

In the display unit 5, a plurality of scanning lines 66 that extends from the scanning line driving circuit 61 and a plurality of data lines 68 that extends from the data line driving circuit 62 are formed. In addition, pixels 40 are disposed in correspondence with intersections of the plurality of scanning lines and the plurality of data lines.

The scanning line driving circuit 61 is connected to the pixels 40 through m scanning lines 66 (Y1, Y2, . . . , Ym). The scanning line driving circuit 61 sequentially selects the scanning lines 66 of the 1st row to the m-th row under the control of the controller 63 and supplies a selection signal that defines an ON-timing of a driving TFT 41 (see FIG. 2) disposed in each pixel 40 through the selected scanning line 66.

The data line driving circuit 62 is connected to the pixels 40 through n data lines 68 (X1, X2, . . . , Xn) and supplies an image signal that defines one bit image data corresponding to each pixel 40 to the pixel 40 under the control of the controller 63.

In addition, in this embodiment, it is assumed that the data line driving circuit supplies a low-level image signal to the pixel 40 in the case where corresponding image data (pixel data) is defined as "0" and supplies a high-level image signal to the pixel 40 in the case where corresponding image data (pixel data) is defined as "1".

In the display unit 5, a low-electric potential power source line 49, a high-electric potential power source line 50, a common electrode wiring 55, a first control line 91, and a second control line 92 that extend from the common power source modulating circuit 64 are disposed, and each wiring is connected to the pixels 40. The common power source modulating circuit 64 generates various signals to be supplied to the above-described wirings and electrically connects or disconnects (high impedance state) the wirings, under the control of the controller 63.

Figure 2:
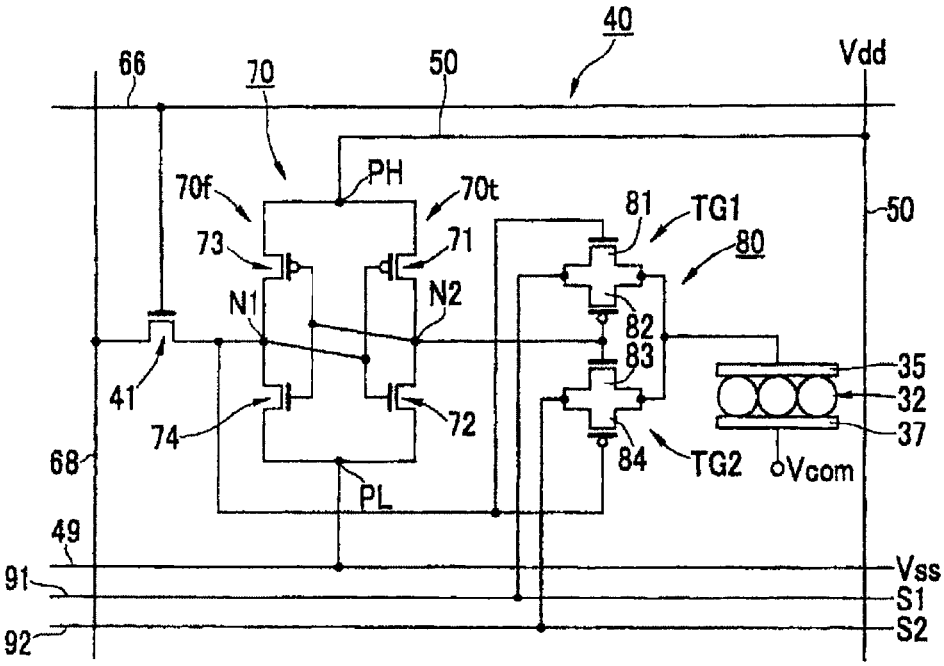
FIG. 2 is a diagram of a circuit configuration of a pixel.

FIG. 2 is a diagram of a circuit configuration of a pixel 40.

In the pixel 40, as shown in FIG. 2, a driving TFT (thin film transistor) 41 (pixel switching element), a latch circuit (memory circuit) 70, a switching circuit 80, an electrophoretic element 32, a pixel electrode 35, and a common electrode 37 are disposed. In other words, the above-described pixel circuits are disposed in each pixel 40. In addition, a scanning line 66, a data line 68, a low-electric potential power source line 49, a high-electric potential power source line 50, a first control line 91, and a second control line 92 are disposed so as to surround the above-described elements. The pixel 40 has the configuration of an SRAM (static random access memory) type in which an image signal is maintained as an electric potential by the latch circuit 70.

The driving TFT 41 is a pixel switching element that is configured by an N-MOS (negative metal oxide semiconductor) transistor. The gate terminal of the driving TFT 41 is connected to the scanning line 66, the source terminal of the driving TFT 41 is connected to the data line 68, and the drain terminal of the driving TFT 41 is connected to a data input terminal N1 of the latch circuit 70. The switching circuit 80 is connected to the data output terminal N2 and the data input terminal N1 of the latch circuit 70 and the pixel electrode 35. In addition, between the pixel electrode 35 and the common electrode 37, the electrophoretic element 32 is pinched.

The latch circuit 70 includes a transfer inverter 70*t* and a feedback inverter 70*f*. Both the transfer inverter 70*t* and the feedback inverter 70*f* are C-MOS inverters. The transfer inverter 70*t* and the feedback inverter 70*f* form a loop structure in which, to each input terminal of one of the transfer inverter and the feedback inverter, the output terminal of the other is connected. In addition, to each inverter, a power source voltage is supplied from the high-electric potential power source line 50 that is connected through a high-electric potential power source terminal PH and the low-electric potential power source line 49 that is connected through a low-electric potential power source terminal PL.

The transfer inverter 70*t* includes a P-MOS transistor 71 and an N-MOS transistor 72 of which the drain terminals are connected to the data output terminal N2. The source terminal of the P-MOS transistor 71 is connected to the high-electric potential power source terminal PH, and the source terminal of the N-MOS transistor 72 is connected to the low-electric potential power source terminal PL. The gate terminals (the input terminal of the transfer inverter 70*t*) of the P-MOS transistor 71 and the N-MOS transistor 72 are connected to the data input terminal N1 (the output terminal of the feedback inverter 70*f*).

The feedback inverter 70*f* includes a P-MOS transistor 73 and an N-MOS transistor 74 of which the drain terminals are connected to the data input terminal N1. The gate terminals (the input terminal of the feedback inverter 70*f*) of the P-MOS transistor 73 and the N-MOS transistor 74 are connected to the data output terminal N2 (the output terminal of the transfer inverter 70*t*).

When pixel data of "1" (an image signal having a high level) is stored in the latch circuit 70, a low-level signal is output from the data output terminal N2 of the latch circuit 70. On the other hand, when pixel data of "0" (an image signal having a low level) is stored in the latch circuit 70, a high-level signal is output from the data output terminal N2.

The switching circuit 80 is configured to include a first transmission gate TG1 and a second transmission gate TG2.

The first transmission gate TG1 is configured by an N-MOS transistor 81 and a P-MOS transistor 82. The source terminals of the N-MOS transistor 81 and P-MOS transistor 82 are connected to the first control line 91, and the drain terminals of the N-MOS transistor 81 and P-MOS transistor 82 are connected to the pixel electrode 35. In addition, the gate terminal of the N-MOS transistor 81 is connected to the data input terminal N1 (the drain terminal of the driving TFT 41) of the latch circuit 70, and the gate terminal of the P-MOS transistor 82 is connected to the data output terminal N2 of the latch circuit 70.

The second transmission gate TG2 is configured by an N-MOS transistor 83 and a P-MOS transistor 84. The source terminals of the N-MOS transistor 83 and P-MOS transistor 84 are connected to the second control line 92, and the drain terminals of the N-MOS transistor 83 and the P-MOS transistor 84 are connected to the pixel electrode 35. In addition, the gate terminal of the N-MOS transistor 83 is connected to the data output terminal N2 of the latch circuit 70, and a gate terminal of the P-MOS transistor 84 is connected to the data input terminal N1 of the latch circuit 70.

Here, in the case where a pixel data of "1" (an image signal having the high level) is stored in the latch circuit 70, and a low-level signal is output from the data output terminal N2, the first transmission gate TG1 is in the ON state, and accordingly, an electric potential S1, which is supplied through the first control line 91, is input to the pixel electrode 35. On the other hand, in the case where a pixel data of "0" (an image signal having the low level) is stored in the latch circuit 70, and a high-level signal is output from the data output terminal N2, the second transmission gate TG2 is in the ON state, and accordingly, an electric potential S2, which is supplied through the second control line 92, is input to the pixel electrode 35.

Figure 3:
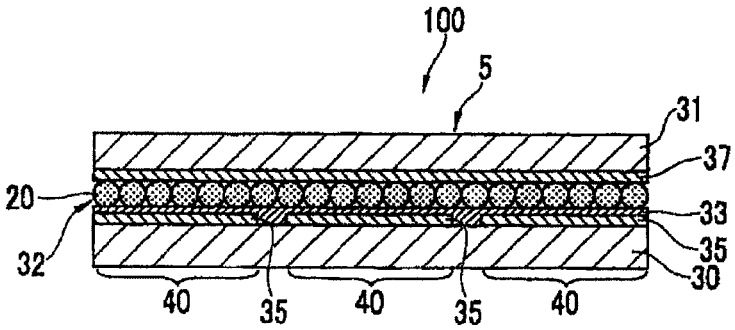
FIG. 3 is a partial cross-sectional view, which shows a display unit, of an electrophoretic display device according to the first embodiment.

FIG. 3 is a partial cross-sectional view, which shows the display unit 5, of the electrophoretic display device 100 according to this embodiment.

The electrophoretic display device 100 has a configuration in which an electrophoretic element 32 formed by arranging a plurality of microcapsules 20 is pinched between a component substrate 30 and an opposing substrate 31. In the display unit 5, a plurality of the pixel electrodes 35 is formed so as to be arranged on the electrophoretic element 32 side of the component substrate 30, and the electrophoretic element 32 is bonded to the pixel electrode 35 through an adhesive agent layer 33.

The component substrate 30 is a substrate that is formed from glass, plastic, or the like. Since the component substrate 30 is disposed on a side opposite to the image displaying surface, the component substrate 30 may not be configured to be transparent. The pixel electrode 35 is an electrode that is acquired by stacking a nickel plate and a gold plate on a Cu thin film in the mentioned order or is formed from Al, ITO (indium tin oxide), or the like. Although not shown in the figure, the scanning line 66, the data line 68, the driving TFT 41, the latch circuit 70, and the like that are shown in FIG. 1 or 2 are formed between the pixel electrode 35 and the component substrate 30.

The opposing substrate 31 is a substrate that is formed from glass, plastic, or the like. Since the opposing substrate 31 is disposed on the side of the image displaying surface, the opposing substrate 31 is formed as a transparent substrate. On the electrophoretic element 32 side of the opposing substrate 31, a flat common electrode 37 (opposing electrode) is formed so as to face the plurality of pixel electrodes 35. In addition, the electrophoretic element 32 is disposed on the common electrode 37. The common electrode 37 is a transparent electrode that is formed of MgAg, ITO, IZO (indium zinc oxide), or the like.

In addition, the electrophoretic element 32 is formed on the opposing substrate 31 side in advance. Generally, the electrophoretic element 32 is handled as an electrophoretic sheet that includes up to the adhesive agent layer 33. In the manufacturing process, the electrophoretic sheet is handled in a state in which a protection peel-off sheet is attached to the surface of the adhesive agent layer 33. Then, by attaching the electrophoretic sheet, from which the peel-off sheet is detached, to the component substrate 30 (on which the pixel electrode 35 and various circuits are formed) that is separately manufactured, the display unit 5 is formed. Accordingly, the adhesive agent layer 33 is placed only on the pixel electrode 35 side.

Figure 4:
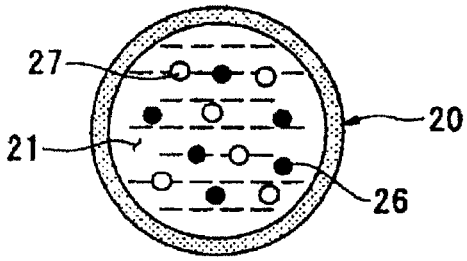
FIG. 4 is a schematic cross-sectional view of a microcapsule.

FIG. 4 is a schematic cross-sectional view of the microcapsule 20.

The microcapsule 20, for example, has a particle diameter of about 50 μm and is a sphere-shaped body in which a dispersion medium 21, a plurality of white particles (electrophoretic particles) 27, and a plurality of black particles (electrophoretic particles) 26 are enclosed. The microcapsule 20, as shown in FIG. 3, is pinched by the common electrode 37 and the pixel electrode 35, and one or a plurality of microcapsules 20 is disposed within one pixel 40.

The outer shell part (wall film) of the microcapsule 20 is formed of a transparent high molecular resin such as an acryl resin including polymethylmethacrylate, polyethylmethacrylate, or the like, urea resin, gum Arabic, or the like.

The dispersion medium 21 is a liquid that disperses the white particles 27 and the black particles 26 into the microcapsule 20. As the dispersion medium 21, water; an alcohol-based solvent such as methanol, ethanol, isopropanol, butanol, octanol, or methyl cellosolve; esters such as ethyl acetate or butyl acetate; ketones, such as acetone, methylethylketone, or methylisobutylketone; aliphatic hydrocarbon such as pentane, hexane, or octane; alicyclic hydrocarbon such as cyclohexane or methylcyclohexane; aromatic hydrocarbon such as benzene, toluene, or benzene having a long-chain alkyl group including xylene, hexylbenzene, heptylbenzene, octylbenzene, nonylbenzene, decylbenzene, undecylbenzene, dodecylbenzene, tridecylbenzene, or tetradecylbenzene; halogenated hydrocarbon such as methylene chloride, chloroform, carbon tetrachloride, or 1,2-dichloroethane; carboxylate; or other kinds of oils can be used. The above-described materials may be used in the form of a single material or a mixture. Further, a surfactant, or the like, may be added to the above-described material.

The white particles 27 are particles (polymers or colloids) made of white pigment such as titanium dioxide, zinc oxide, or antimony trioxide and, for example, are used in a negatively charged state. The black particles 26 are particles (polymer particles or colloids) made of black pigment such as aniline black or carbon black and, for example, are used in a positively charged state.

In addition, a charge control agent containing particles of an electrolyte, a surfactant, metal soap, a resin, rubber, oil, varnish, a compound, or the like; a dispersant such as a titanium-based coupling agent, an aluminum-based coupling agent, and a silane-based coupling agent; a lubricant; a stabilizing agent; or the like may be added to the above-described pigment, as needed.

Instead of the black particles 26 and the white particles 27, for example, pigment of a red color, a green color, a blue color, or the like may be used. Under such a configuration, the red color, the green color, the blue color, or the like may be displayed in the display unit 5.

FIGS. 5A and 5B are explanatory diagrams of the operation of the electrophoretic element. FIG. 5A shows a case where the white display (second gray scale) is represented by the pixel 40, and FIG. 5B shows a case where the black display (first gray scale) is represented by the pixel 40.

In the case of the white display shown in FIG. 5A, a relatively high electric potential is maintained in the common electrode 37, and a relatively low electric potential is maintained in the pixel electrode 35. Accordingly, white particles 27 that are negatively charged are attracted to the common electrode 37, and black particles 26 that are positively charged are attracted to the pixel electrode 35. As a result, when this pixel is viewed from the common electrode 37 side that becomes the displaying surface side, a white color is recognized.

In the case of the black display shown in FIG. 5B, a relatively low electric potential is maintained in the common electrode 37, and a relatively high electric potential is maintained in the pixel electrode 35. Accordingly, the black particles 26 that are positively charged are attracted to the common electrode 37, and the white particles 27 that are negatively charged are attracted to the pixel electrode 35. As a result, when this pixel is viewed from the common electrode 37 side, a black color is recognized.

In the electrophoretic display device 100, an image signal is stored in the latch circuit 70 as an electric potential by inputting the image signal to the data input terminal N1 of the latch circuit 70 through the driving TFT 41. Then, either the first control line 91 or the second control line 92 is connected to the pixel electrode 35 by the switching circuit 80 that operates in accordance with the electric potential that is output from the data output terminal N2 of the latch circuit 70. Accordingly, the electric potential corresponding to the image signal is input to the pixel electrode 35. Thus, as shown in FIG. 5, the black display or the white display is represented by the pixel 40 based on an electric potential difference between the pixel electrode 35 and the common electrode 37.

FIG. 6 is a block diagram showing the details of the controller 63 of the electrophoretic display device 100.

The controller 63 includes a control circuit 161 as a CPU (central processing unit), an EEPROM (electrically-erasable and programmable read-only memory; memory unit) 162, a voltage generating circuit 163, a data buffer 164, a frame memory 165, a memory control circuit 166, and an image removing area setting circuit 167.

The control circuit 161 generates control signals (timing pulses) such as a clock signal, a horizontal synchronization signal, and a vertical synchronization signal and supplies these control signals to circuits that are disposed on the periphery of the control circuit 161.

In the EEPROM 162, setting values and the like needed for the control circuit 161 to control the operation of each circuit is stored. In the EEPROM 162, preset image information that is used for the display of the operation state of the electrophoretic display device may be stored.

The voltage generating circuit 163 is a circuit that supplies driving voltages to the scanning line driving circuit 61, the data line driving circuit 62, and the common power source modulating circuit 64.

The data buffer 164 is an interface unit of the controller 63 for a higher level apparatus. The data buffer 164 maintains the image data D that is input from the higher-level apparatus and transmits the image data D to the control circuit 161.

The frame memory 165 has a memory space in which a read operation or a write operation can be performed in correspondence with the arrangement of the pixels 40 of the display unit 5. The memory control circuit 166 expands the image data D, which is supplied from the control circuit 161, in correspondence with the arrangement of the pixels of the display unit 5 in accordance with a control signal and writes the expanded image data into the frame memory 165. The frame memory 165 sequentially transmits a data group that is constituted by stored image data D to the data line driving circuit 62 as image signals.

The data line driving circuit 62 latches one line of the image signals that are transmitted from the frame memory 165 based on a control signal that is supplied from the control circuit 161. Then, the data line driving circuit 62 supplies the latched image signals to the data line 68 in synchronization with the sequential selection operation of the scanning line driving circuit 61 for the scanning line 66.

The image removing area setting circuit 167 sets an image removing area constituted by the pixels 40 that are driven at the time of image removal based on the image data D that is expanded into the frame memory 165 and outputs pixel information that constitutes the image removing area to the control circuit 161.

Driving Method

Next, a driving method relating to the image update of the electrophoretic display device 100 will be described. According to this embodiment, as an example, a driving method for a case where a square image is displayed, and then, update to a rectangular image having the horizontal side longer than the vertical side is made will be described.

Figure 7:
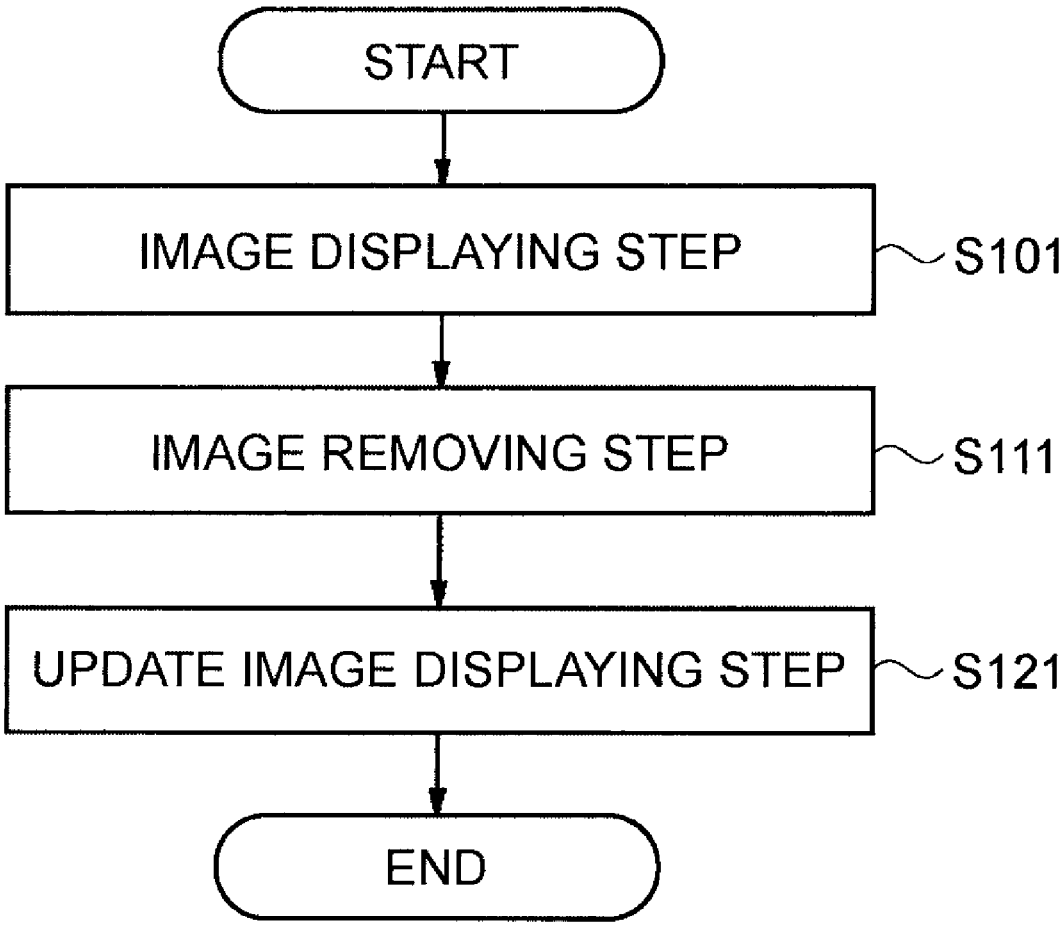
FIG. 7 is a flowchart relating to image update.

FIG. 7 is a flowchart relating to the image update. As shown in FIG. 7, steps relating to the image update include an image displaying step S101, an image removing step S111, and an update image displaying step S121.

Image Displaying Step

Figure 8:
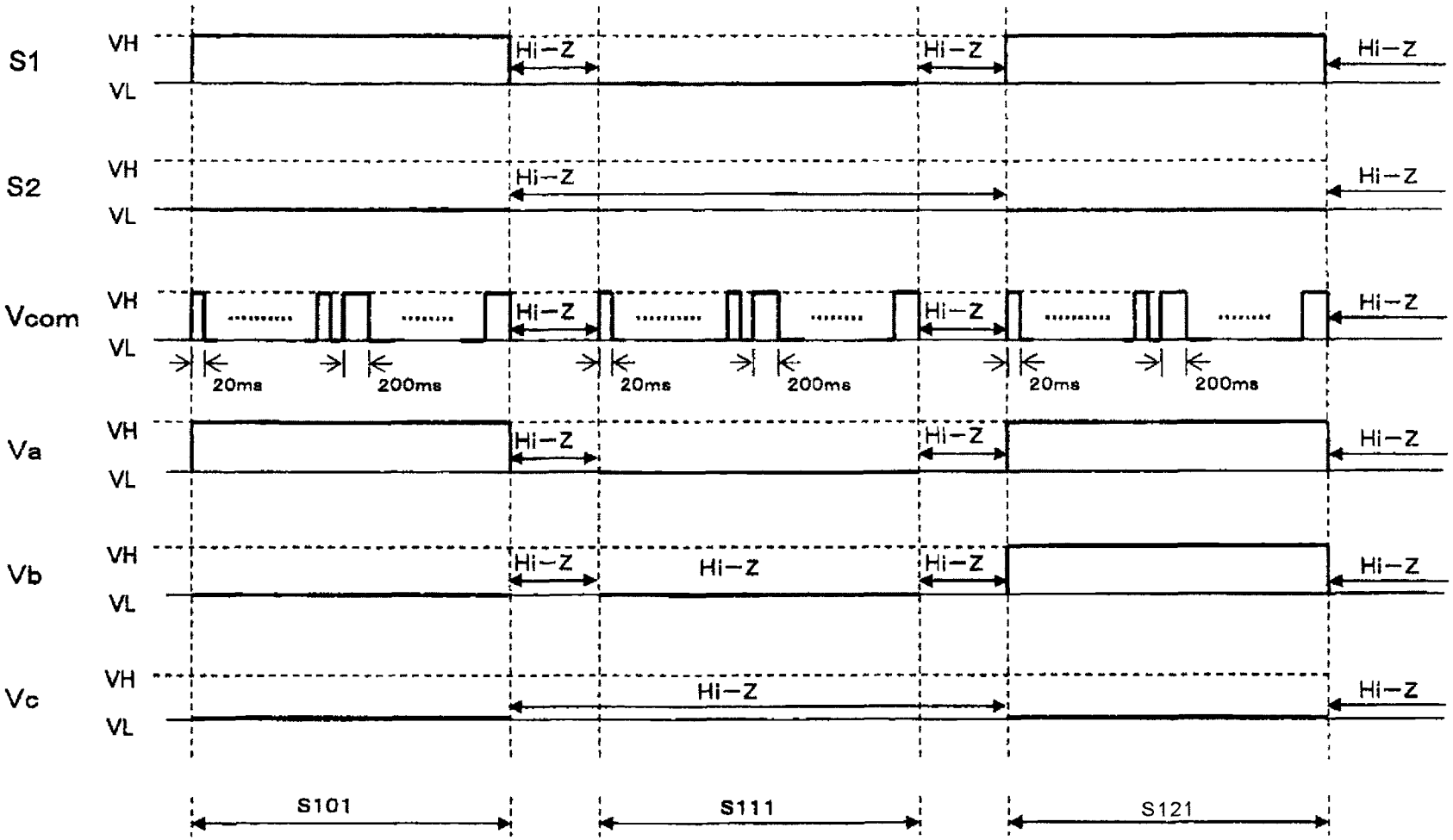
FIG. 8 is a timing chart relating to the image update.
Figure 9A:
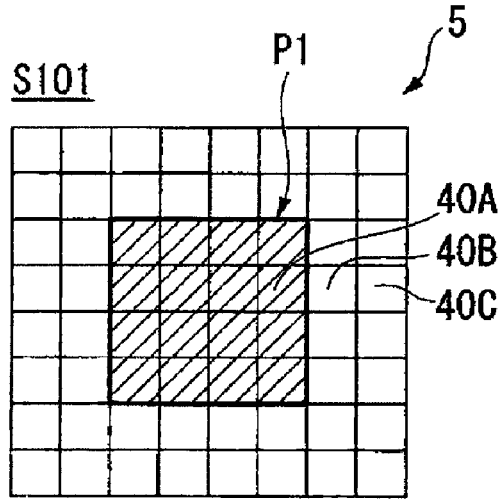
FIGS. 9A to 9C are diagrams showing a change in the displayed image at the time of the image update.
Figure 9B:
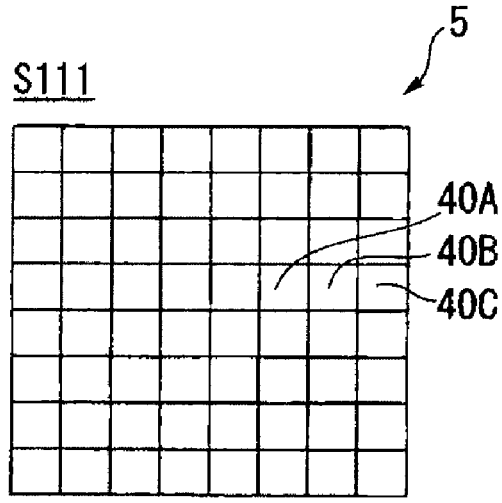
Figure 9C:
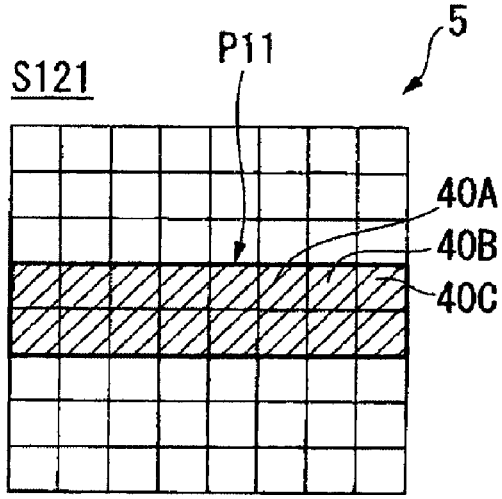
Figure 10:
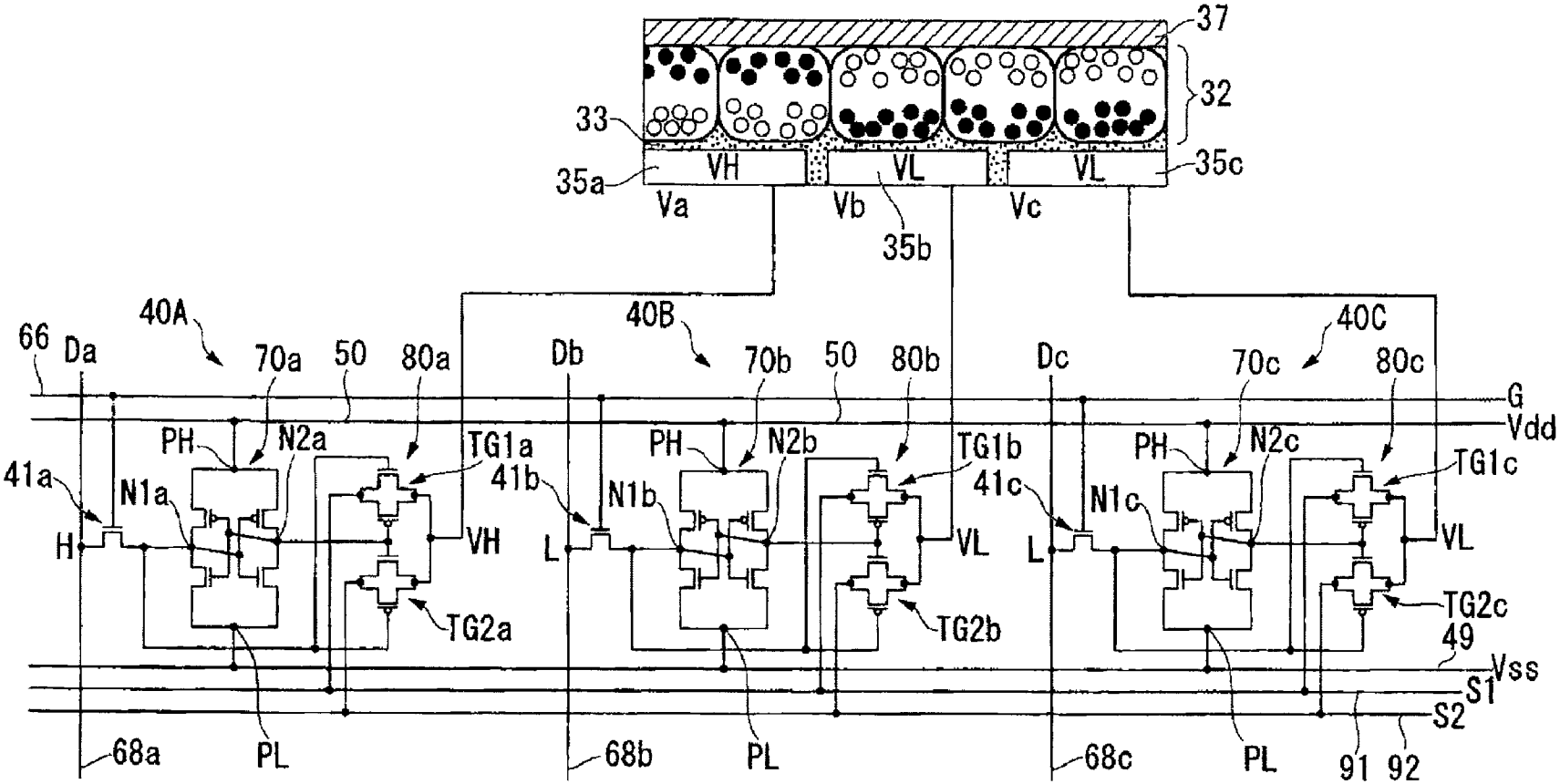
FIG. 10 is a diagram showing the relationship of electric potentials of pixels in an image displaying step.

First, the image displaying step S101 will be described. The image displaying step S101 is a step for displaying an image in the display unit 5. FIG. 8 is a timing chart relating to the image update. FIGS. 9A to 9C are diagrams showing a change in the displayed image at the time of the image update. FIG. 10 is a diagram showing the relationship of electric potentials of pixels 40A, 40B, and 40C in the image displaying step S101.

In FIG. 8 and FIGS. 9A to 9C, a timing chart and displayed images in the display unit 5 corresponding to the image displaying step S101 to the update image displaying step S121 are shown.

In FIGS. 9A to 9C and FIG. 10, the pixel 40A is the pixel 40 that forms the contour of an image P1, and the pixel 40B is the pixel 40 that is disposed to be adjacent to the pixel 40A and forms the background. In addition, the pixel 40C is the pixel 40 that is disposed to be adjacent to the pixel 40B and forms a background. The pixel 40C is the pixel 40 that is disposed on a side opposite to the pixel 40A with respect to the pixel 40B. A combination of these pixels 40A, 40B, and 40C may be selected arbitrarily. For example, although the pixels 40A, 40B, and 40C shown in FIG. 10 are the pixels 40 belonging to a same scanning line 66, however, the pixels 40A, 40B, and 40C may be the pixels 40 that belong to a same data line 68.

In addition, in FIGS. 8 and 10, subscripts "a", "b", and "c" that are included in reference signs are attached only for the purpose of clearly identifying three pixels 40 (40A, 40B, and 40C) to be described and constituent elements thereof. In the description below, in the case where a pixel 40 located in a specific area is indicated, when any one of the pixels 40A, 40B, and 40C is included in the specific area, the reference sign is added in a parenthesis such as "pixel 40 (40A)".

In FIG. 8, the electric potential S1 of the first control line 91, the electric potential S2 of the second control line 92, the electric potential Va of the pixel electrode 35*a*, the electric potential Vb of the pixel electrode 35*b*, and the electric potential Vcom of the common electrode 37 are shown. In FIGS. 9A to 9C, a part of the display unit 5 in which the image P1 is displayed is shown as extracted 8 pixels×8 pixels.

According to the driving method of this embodiment, before an image is displayed, image signals are input to the latch circuits 70 (70*a*, 70*b*, and 70*c*) of all the pixels 40 (40A, 40B, and 40C).

As shown in FIG. 10, a high-level (H) image signal is input to the latch circuit 70*a* of the pixel 40A, in which the black display is represented by forming the image P1, from the data line 68*a* through the driving TFT 41*a*. On the other hand, a low-level (L) image signal is input to the latch circuits 70*b* and 70*c* of the pixels 40B and 40C, in which the white display is represented by forming the background, from the data lines 68*b* and 68*c* through the driving TFTs 41*b* and 41*c*.

When the image signals are input to the latch circuits 70*a*, 70*b*, and 70*c*, the electric potential Vdd of the high-electric potential power source line 50 is set to a high level (VH) that is used for image display, and the electric potential Vss of the low-electric potential power source line 49 is set to a low level (VL). Accordingly, the electric potential of the data input terminal N1*a* of the pixel 40A becomes the high level (VH; Vdd), and the electric potential of the data output terminal N2*a* of the pixel 40A becomes the low level (VL; Vss). In addition, the electric potentials of the data input terminals N1*b* and N1*c* of the pixels 40B and 40C become the low level (VL; Vss), and the electric potentials of the data output terminals N2*b* and N2*c* of the pixels 40B and 40C become the high level (VH; Vdd).

Accordingly, when the image signals are input to the latch circuits 70*a*, 70*b*, and 70*c* of the pixels 40A, 40B, and 40C, as shown in FIG. 8, the high-level electric potential VH is supplied to the first control line 91, and the low-level electric potential VL is supplied to the second control line 92.

In the pixel 40A to which the high-level (H) image signal is input, the electric potential of the data input terminal N1*a* becomes the high level (VH; Vdd), and the electric potential of the data output terminal N2*a* becomes the low level (VL; Vss). Accordingly, the transmission gate TG1*a* of the switching circuit 80*a* is in the ON state, and the high-level electric potential VH is supplied from the first control line 91 to the pixel electrode 35*a*.

On the other hand, in the pixels 40B and 40C to which the low-level (L) image data is input, the electric potentials of the data input terminals N1*b* and N1*c* become the low level (L), and the electric potentials of the data output terminals N2*b* and N2*c* become the high level (H). Accordingly, the transmission gate TG2*b* of the switching circuit 80*b* is in the ON state, and the low-level electric potential VL is supplied from the second control line 92 to the pixel electrodes 35*b* and 35*c*.

In addition, a pulse-shaped signal in which a period of the high level (VH) and a period of the low level (VL) are periodically repeated is input to the common electrode 37.

In such a case, a voltage corresponding to an electric potential difference between the pixel electrode 35*a* and the common electrode 37 is applied to the electrophoretic element 32 during the period in which the common electrode 37 is the low level (VL). Accordingly, as shown in FIG. 5B, the positively charged black particles 26 are attracted to the common electrode 37 side, and the negatively charged white particles 27 are attracted to the pixel electrode 35*a* side. Therefore, during the above-described period, the black display is represented by the pixel 40A, and the square image P1 shown in FIG. 9A is displayed.

In addition, a voltage corresponding to electric potential differences between the pixel electrodes 35*b* and 35*c* and the common electrode 37 is applied to the electrophoretic element 32 during the period in which the common electrode 37 is at the high level (VH). Accordingly, as shown in FIG. 5A, the negatively charged white particles 27 are attracted to the common electrode 37 side, and the positively charged black particles 26 are attracted to the pixel electrode 35*b* and 35*c* sides. Therefore, during the above-described period, the white display is represented by the pixels 40B and 40C, and the background is formed.

In the driving method according to this embodiment, a pulse-shaped signal in which the high level (VH) and the low level (VL) are periodically repeated is input to the common electrode 37 for a plurality of periods. Such a driving method is referred to as "common swing driving" in the description here. The common swing driving is defined as a driving method in which a pulse, in which the high level (VH) and the low level (VL) are repeated, is applied to the common electrode 37 for at least one or more periods for displaying an image. In addition, it is preferable that the frequency and the number of the periods in the common swing driving are appropriately set based on the specifications and the characteristics of the electrophoretic element 32.

When the square image P1 is displayed, the first control line 91, the second control line 92, and the common electrode 37 are electrically disconnected from each other by the common power source modulating circuit 64 so as to be in the high-impedance state. In addition, the pixel electrodes 35 (35*a*, 35*b*, and 35*c*) to which the voltages are supplied from the first control line 91 and the second control line 92 are also in the high-impedance state, and whereby the image displaying step S101 is completed. At this moment, the latch circuits 70 (70*a*, 70*b*, and 70*c*) are driven, and the input image signals are stored therein.

Image Removing Step

Next, the image removing step S111 will be described. However, before the description is made, a case where only the image P1 is selectively removed by driving only the pixel 40(A) that forms the image P1 will be described.

Figure 11A:
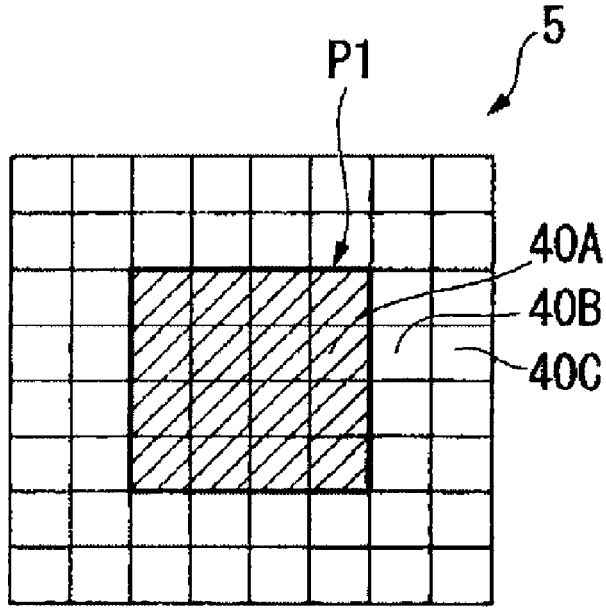
FIG. 11A is a diagram showing a display form before removal of an image P1.
Figure 11B:
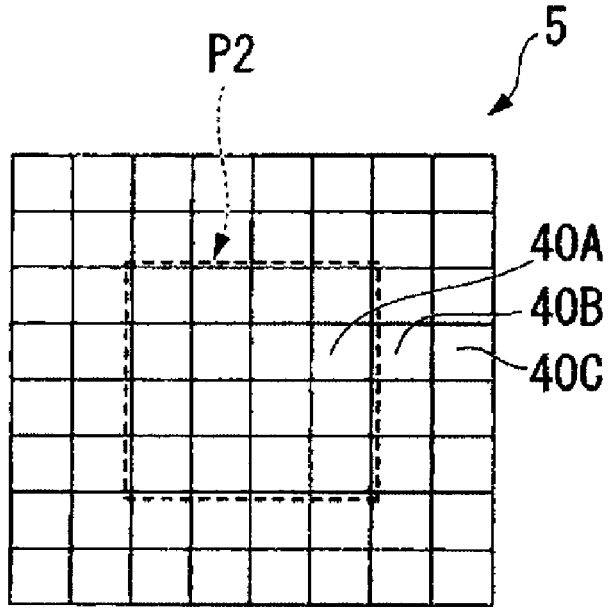
FIG. 11B is a diagram showing a display form after the image P1 is selectively removed.

FIGS. 11A and 11B are diagrams showing a change in the display unit 5 at the time when the image P1 is selectively removed. FIG. 11A shows a state before the removing operation, and FIG. 11B shows a state after the removing operation. When the image removing is performed by driving only the pixel 40 (40A) that forms the image P1 shown in FIG. 11A, as shown in FIG. 11B, an afterimage P2 is generated along the contour of the image P1 in the display unit 5. Such an afterimage P2 is generated near a boundary between the pixel 40 (40A) that forms the contour and the pixel 40 (40B) that is disposed to be adjacent to the pixel 40 (40A) and constitutes the background.

As shown in FIGS. 8 and 10, when the image P1 is displayed in the image displaying step S101, a high-level (VH) electric potential is supplied to the pixel electrode 35 (35*a*) of the pixel 40 (40A) that forms the image P1, and a low-level (VL) electric potential is supplied to the common electrode 37. At this moment, an electric field is generated in the diagonal direction from the pixel electrode 35 (35*a*) of the pixel 40 (40A) that forms the image P1 toward the common electrode 37 located on the background side. In accordance with the diagonal electric field, the black display is represented also in an area near the boundary between the image P1 and the background, and accordingly, the contour portion of the image P1 is slightly raised.

Then, when only the image P1 is removed, only the contour portion that is raised remains to be the afterimage P2. Thus, according to this embodiment, the image P1 is removed by using the driving method described below.

Figure 12:
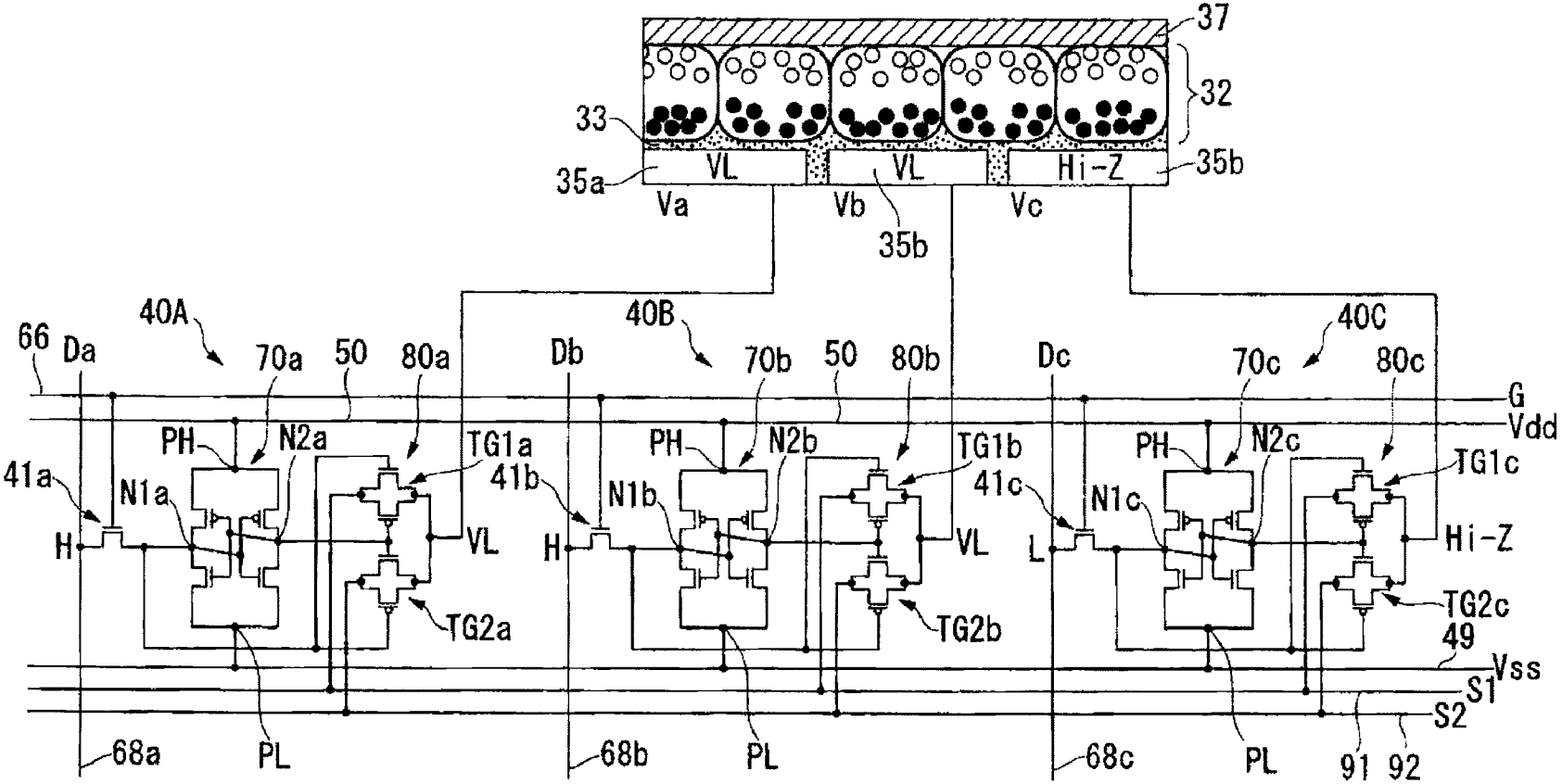
FIG. 12 is a diagram showing the relationship of electric potentials of pixels in an image removing step.
Figure 13:
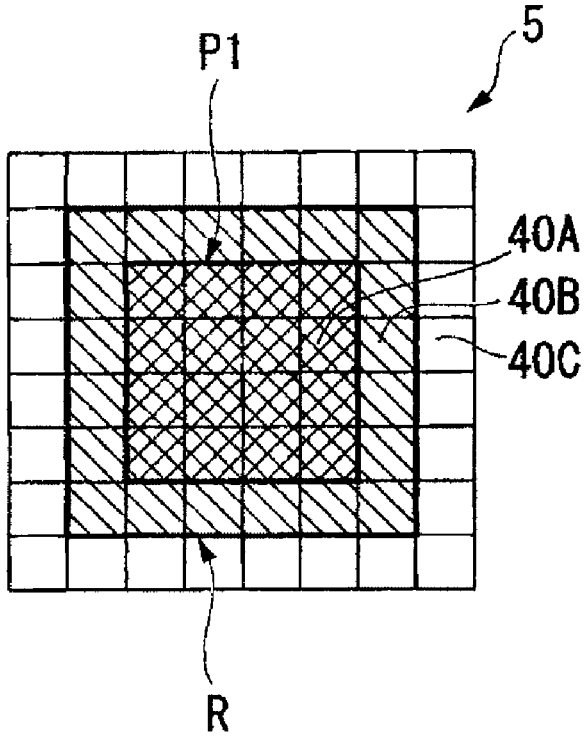
FIG. 13 is a diagram showing an image removing area R.

The image removing step S111 is a step for removing the image P1 by setting an image removing area that is constituted by an area for forming the image P1 and an area framing the contour of the image P1 and driving only the pixels 40 (40A and 40B) that constitute the image removing area. FIG. 12 is a diagram showing the relationship of electric potentials of the pixels 40A, 40B, and 40C relating to the image removing step S111. FIG. 13 is a diagram showing the image removing area R. FIG. 12 is a diagram corresponding to FIG. 10. To each constituent element shown in FIG. 12 that is common to FIG. 10, a same reference sign is attached. In FIG. 13, the image P1 and the image removing area R are shown.

Here, a method of setting the image removing area R will be described. The image removing area setting circuit 167 extracts the pixel 40 (40B), which is disposed on the background side to be adjacent to the pixel 40 (40A) that forms the contour of the image P1, from the image data D that is expanded in the frame memory 165. The pixel 40 (40B) extracted as described above configures a band-shaped area, which has a width corresponding to one pixel, framing the contour of the image P1. These pixels 40 (40B), for example, are extracted by using a general technique that is employed by image processing software.

Then, the image removing area setting circuit 167 sets an area that is formed by the pixel 40 (40A) forming the image P1 and the pixel 40 (40B) framing the contour of the image P1 as the image removing area R. The set image removing area R, as shown in FIG. 13, is formed as an area that is acquired by broadening the image P1 to the outer side by one pixel.

The pixel information that configures the image removing area R is output from the image removing area setting circuit 167 to the control circuit 161, and image data D for image removal is generated by the control circuit 161. The image data D for image removal that is generated by the control circuit 161 is expanded into the frame memory 165, and then is input to the latch circuits 70 (70*a*, 70*b*, and 70*c*) of the pixels 40 (40A, 40B, and 40C).

According to this embodiment, the pixels 40 (40B) framing the image P1 are extracted from the image data D after being expanded into the frame memory 165. However, the pixel 40 (40B) framing the contour of the image P1 may be configured to be extracted by analyzing the image data D before expansion by using the control circuit 161. In such a case, the process from the setting of the image removing area R to generating of the image data D for image removal is performed consistently by the control circuit 161.

Figure 14:
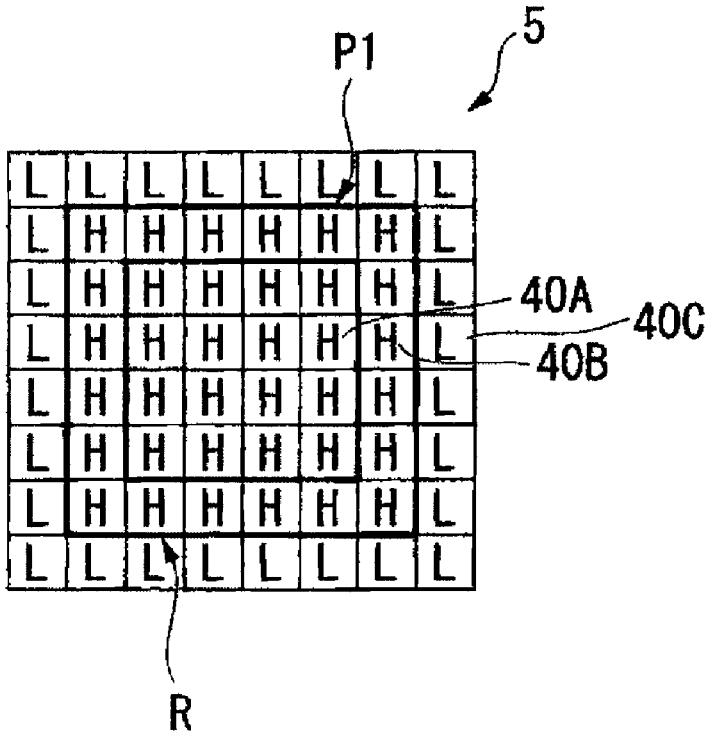
FIG. 14 is a diagram showing disposition of image signals at the time of image removal.

FIG. 14 is a diagram showing image signals that are input at the time of image removal in correspondence with the display unit 5. As shown in FIG. 14, a high-level (H) image signal is input to the area that is broadened from the image P1 to the outer side by one pixel, and a low-level (L) image signal is input to a peripheral area surrounding the image removing area R.

The transmission gates TG1 (TG1*a* and TG1*b*) of the pixels 40 (40A and 40B) to which the high-level (H) image signal is input are in the ON state. On the other hand, the transmission gate TG2 (TG2*c*) of the pixel 40 (40C) to which the low-level (L) image signal is input is in the ON state.

When the image signals are input to the latch circuits 70 (70*a*, 70*b*, and 70*c*), the electric potentials of the high-electric potential power source line 50 and the low-electric potential power source line 49 are set to the electric potentials (VH and VL) for image display.

Accordingly, when the image signal for the image removal is input, as shown in FIG. 8, a low-level electric potential (VL) is supplied to the first control line 91, and the second control line 92 is in the high impedance state. A pulse-shaped signal in which a period of the high level (VH) and a period of the low level (VL) are repeated is supplied to the common electrode 37. In addition, the electric potentials of the high-electric potential power source line 50 and the low-electric potential power source line 49 are set to the electric potentials (VH and VL) for image display.

The pixel electrodes 35 (35*a* and 35*b*) of the pixels 40 (40A and 40B) having the latch circuits 70 to which the high-level (H) image signals are input are connected to the first control line 91 and are supplied with the low-level (VL) electric potential. On the other hand, the pixel electrode 35 (35*c*) of the pixel 40 (40C) having the latch circuit 70 to which the low-level (L) image signal is input is connected to the second control line 92 and is in the high-impedance state.

Accordingly, in the pixels 40 (40A and 40B) that constitute the image removing area R to which the high-level (H) image signals are input, a voltage corresponding to an electric potential difference between the pixel electrodes 35 (35*a* and 35*b*) and the common electrode 37 are applied to the electrophoretic element 32 during a period in which the high-level (VH) electric potential is supplied to the common electrode 37. Accordingly, in the image removing area R, the black particles 26 move to the pixel electrode 35 side, and the white particles 27 move to the common electrode 37 side, whereby the image P1 is removed.

At this moment, the pixel 40 (40B) that frames the contour of the image P1 is driven. Accordingly, even in an area raised from the contour of the image P1, the black particles 26 move to the pixel electrode 35 side, and the white particles 27 move to the common electrode 37 side. Therefore, any afterimage is not generated after the image P1 is removed.

During a period in which the low-level (VL) electric potential is supplied to the common electrode 37, the pixel electrodes 35 (35*a* and 35*b*) and the common electrode 37 have the same electric potential, and accordingly, there is little influence on the movement of the black particles 26 and the white particles 27.

On the other hand, in the pixel 40 (40C) to which the low-level (L) image signal is input, the pixel electrode 35 (35*c*) is in the high-impedance state. Accordingly, even when a pulse is supplied to the common electrode 37, there is little influence on the movement of the black particles 26 and the white particles 27, and whereby the white display is maintained.

Accordingly, as shown in FIG. 9B, when the image P1 is removed, the white display is represented over the entire area of the display unit 5.

In addition, a same signal as the pulse that is input to the common electrode 37 may be configured to be input to the second control line 92. In such a case, in the pixel 40 (40C) to which the low-level image signal is input, the pixel electrode 35 (35*c*) and the common electrode 37 have the same electric potential. Accordingly, there is little influence on the movement of the black particles 26 and the white particles 27, and whereby the white display of the background can be maintained.

Here, for example, the signal that is input to the common electrode 37 in the image removing step S111, is a signal in which pulses, of which the high-level electric potential (VH) is 15 V, the low-level electric potential (VL) is 0 V, and the pulse width and the number of the pulses are 20 ms×30 pulses and 200 ms×4 pulses, are continuous. When the image P1 is removed, as shown in FIG. 8, the first control line 91, the second control line 92, and the common electrode 37 are in the high-impedance state, and the process proceeds to the update image displaying step S121.

Update Image Displaying Step

The update image displaying step S121 is a step for displaying an update image P11 shown in FIG. 9C. In the update image displaying step S121, the driving operation is the same as that in the image displaying step S101 after the image signals for image update are input to the latch circuits 70 of the pixels 40.

Figure 15:
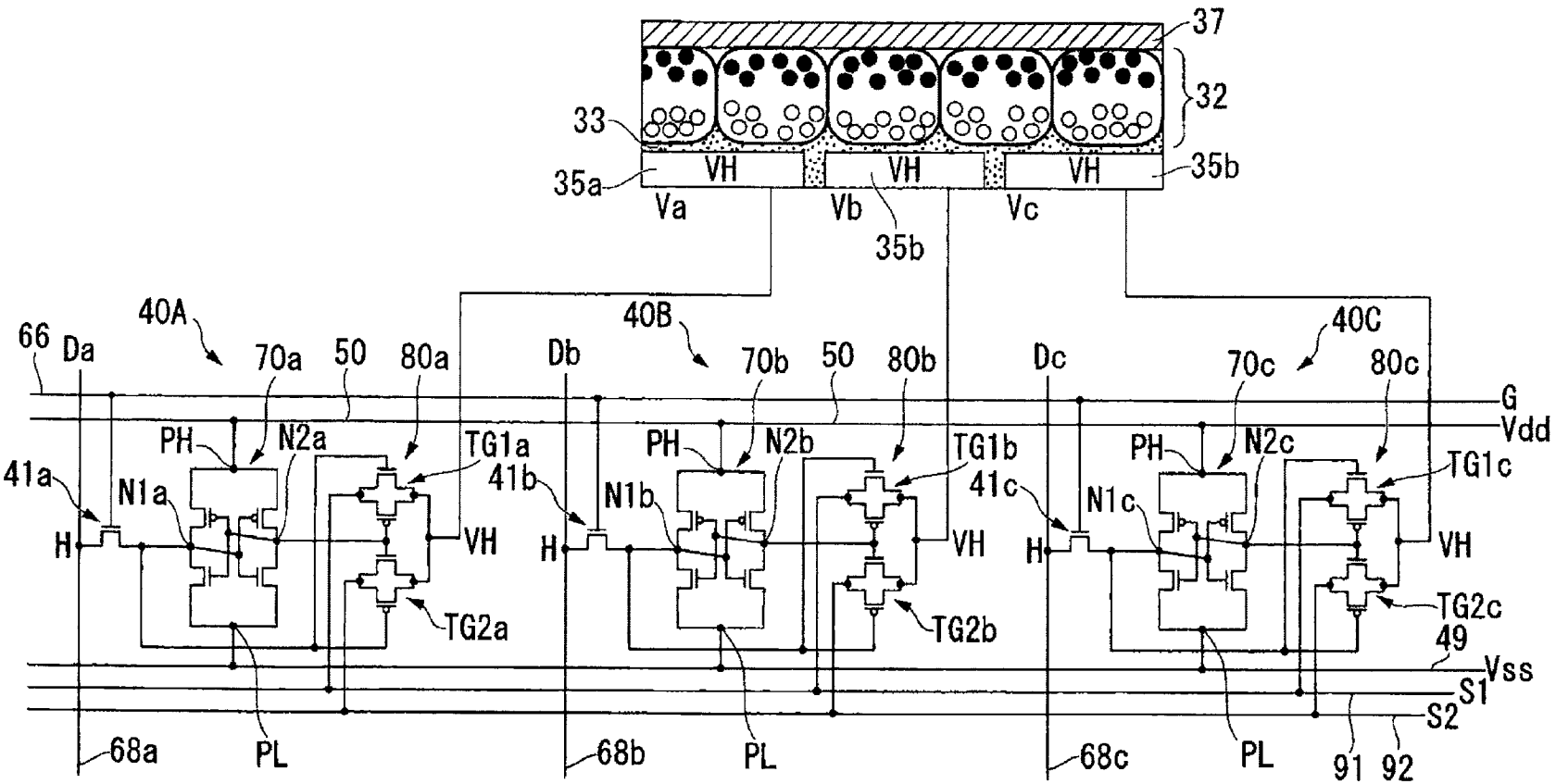
FIG. 15 is a diagram showing the relationship of the electric potentials of pixels in an update image displaying step.

FIG. 15 is a diagram showing the relationship of the electric potentials of the pixels 40A, 40B, and 40C in the update image displaying step S121. FIG. 15 is a diagram corresponding to FIGS. 10 and 12. To each constituent element shown in FIG. 15 which is common to FIG. 10 or 12, a same reference sign is attached.

When the process proceeds to the update image displaying step S121, the image data D for image update is output from the control circuit 161 to the frame memory 165. Then, after the image data D is expanded in the frame memory 165 as an image signal for each pixel 40, the image signal is input to the latch circuit 70 of each pixel 40.

All the pixels 40A, 40B, and 40C are pixels 40 that form the update image P11, and accordingly, as shown in FIG. 15, the high-level (H) image signals are input to the latch circuits 70*a*, 70*b*, and 70*c* of the pixels 40A, 40B, and 40C.

The transmission gates TG1 (TG1*a*, TG1*b*, and TG1*c*) of the pixels 40 (40A, 40B, and 40C) having the latch circuits 70, to which the high-level (H) image signals are input, are in the ON state. On the other hand, the transmission gate TG2 of the pixel 40 having the latch circuit 70 to which the low-level (L) image signal is input is in the ON state.

When the image signals are input to the latch circuits 70, the electric potentials (Vdd and Vss) of the high-electric potential power source line 50 and the low-electric potential power source line 49 are set to the electric potentials (VH and VL) for image display. Then, as shown in FIG. 8, the high-level electric potential (VH) is supplied to the first control line 91, and the low-level electric potential (VL) is supplied to the second control line 92. In addition, a pulse-shaped signal in which a period of the high level (VH) and a period of the low level (VL) are repeated is supplied to the common electrode 37.

The pixel electrodes 35 (35*a*, 35*b*, and 35*c*) of the pixels 40 (40A, 40B, and 40C) having the latch circuits 70 to which the high-level (H) image signals are input are connected to the first control line 91 and are supplied with the high-level (VH) electric potentials.

On the other hand, the pixel electrode 35 of the pixels 40 having the latch circuit 70 to which the low-level (L) image signal is input is connected to the second control line 92 and is supplied with the low-level (VL) electric potential.

Accordingly, the black display is represented by the pixels 40 (40 A, 40 B, and 40 C) to which the high-level (H) image signals are input, and the update image P11, shown in FIG. 9C, having a rectangle shape of which the horizontal side is longer than the vertical side is displayed. In addition, the white display is represented by the pixel 40 to which the low-level (L) image signal is input, and the background of the update image P11 is displayed.

As shown in FIG. 9C, only the image P11 is displayed in the display unit 5, and any afterimage of the previous image P1 does not remain.

When the update image P11 is displayed, the first control line 91, the second control line 92, and the common electrode 37 are in the high-impedance state, and the update image displaying step S121 is completed.

When the image is to be updated consecutively, the image removing step S111 and the update image displaying step S121 are repeatedly performed.

According to the electrophoretic display device 100 using the above-described driving method, the following advantages can be acquired.

First, the image removing area R that is configured by the pixels 40 (40A and 40B) that form the image P1 and the pixel 40 (40C) that configures the band-shaped area, which frames the contour of the image P1, corresponding to one pixel is set. Accordingly, the number of pixels driven in the image removing step S111 becomes a minimum. Therefore, the image P1 can be removed without generating any afterimage while suppressing the power consumption.

In addition, it is preferable that the image removing area R is set in accordance with the generation pattern of the afterimage that is different depending on the characteristics of the electrophoretic element 32.

For example, an area that is expanded from the image P1 by two pixels or more may be set as the image removing area R. In such a case, the number of the pixels to be driven is increased, and the advantage in the viewpoint of the power consumption is degraded. However, in such a case, the pixels 40 in the broader range are driven in the image removing step S111, and accordingly, generation of the afterimage can be prevented more assuredly.

In addition, the value acquired by multiplying the voltage of the pulse applied to the electrophoretic element 32 by the time interval of application of the voltage may be changed as is necessary based on the used temperature level, the applied voltage, the individual difference of the electrophoretic sheets, or the like.

Second Embodiment

Next, an electrophoretic display device according to a second embodiment of the invention will be described.

The electrophoretic display device 110 according to the second embodiment has a pixel circuit that is different from that according to the first embodiment. In particular, the electrophoretic display device 110 includes a pixel circuit (a so-called 1T1C type) that is configured by one driving TFT and a holding capacitor, which is simpler than that of the first embodiment. Other configurations and the driving method according to the second embodiment are the same as those according to the first embodiment on the whole. Accordingly, parts of the second embodiment that are different from those of the first embodiment will be described in detail, and description of other configurations will be omitted appropriately. In addition, a constituent part that is the same as that of the first embodiment will be described with a same reference sign attached thereto.

Configuration of Electrophoretic Display Device

First, the entire configuration of the electrophoretic display device according to this embodiment will be described.

Figure 16:
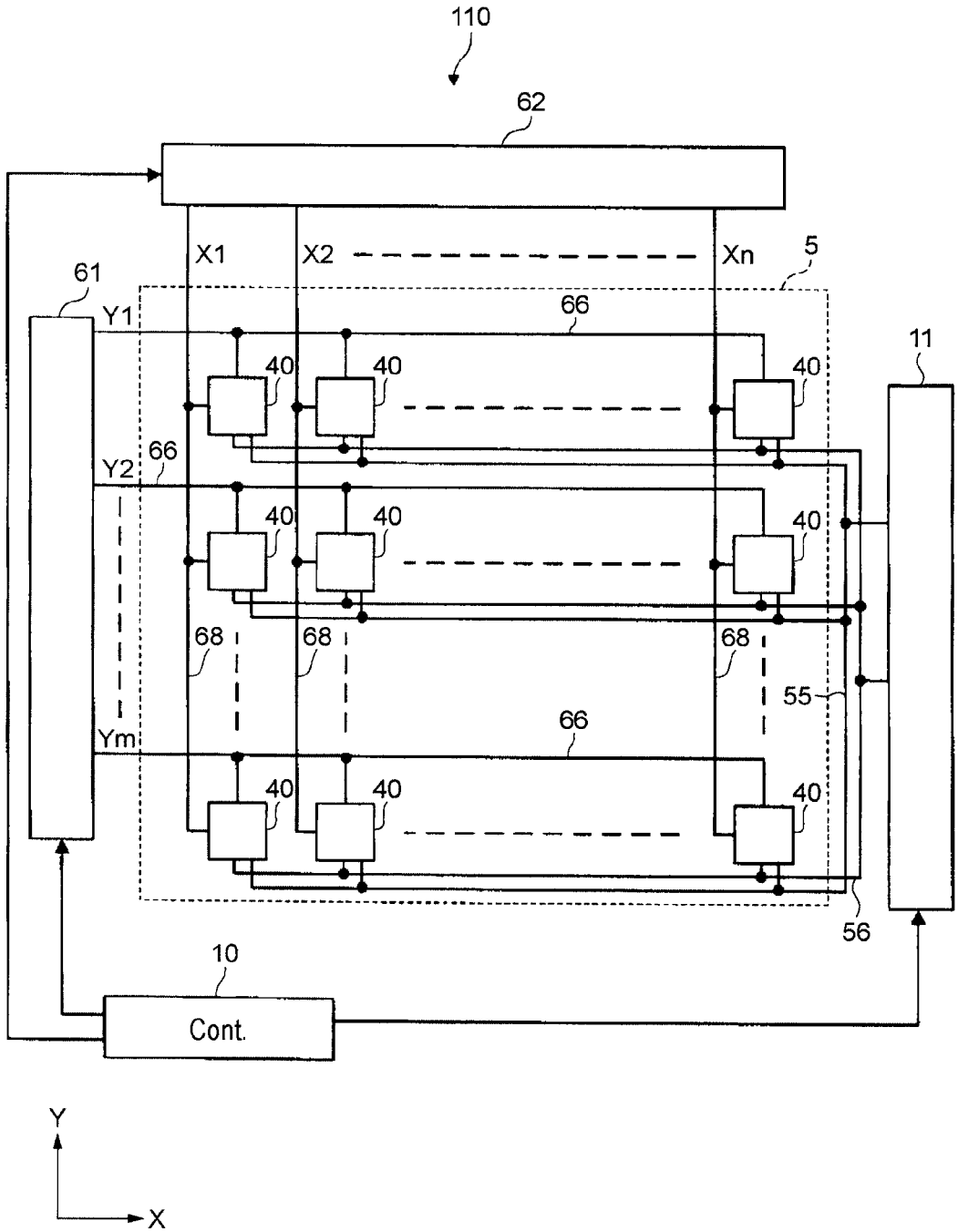
FIG. 16 is a schematic diagram showing the configuration of an electrophoretic display device according to a second embodiment of the invention.

FIG. 16 is a block diagram showing the entire configuration of the electrophoretic display device according to this embodiment.

As shown in FIG. 16, the electrophoretic display device 110 according to this embodiment includes a display unit 5, a controller 10, a scanning line driving circuit 61, a data line driving circuit 62, and a common electrode modulating circuit 11.

In the display unit 5, pixels 40 of m rows×n columns are arranged in a matrix shape (in a two-dimensional plane). In addition, in the display unit 5, m scanning lines 66 (that is, Y1, Y2, . . . , Ym) and n data lines 68 (that is, data lines X1, X2, . . . , Xn) are disposed so as to intersect each other. In particular, the m scanning lines 66 extend in the row direction (that is, direction X), and the n data lines 68 extend in the column direction (that is, direction Y). The pixels 40 are disposed in correspondence with intersections of the m scanning lines 66 and the n data lines 68.

The controller 10 controls the operations of the scanning line driving circuit 61, the data line driving circuit 62, and the common electrode modulating circuit 11. The controller 10 supplies timing signals such as a clock signal and a start pulse to each circuit.

The scanning line driving circuit 61 sequentially supplies scanning signals as pulses to the scanning lines Y1, Y2, . . . , Ym based on timing signals that are supplied from the controller 10. The data line driving circuit 62 supplies image signals to the data lines X1, X2, . . . , Xn based on timing signals supplied from the controller 10. The image signal takes binary levels of a high electric-potential level (hereinafter, referred to as a "high level", for example, of 5 V) or a low electric-potential level (hereinafter, referred to as a "low level", for example, of 0 V).

The common electrode modulating circuit 11 supplies the common electric potential Vcom to the common electrode wiring 55 and supplies the power source electric potential Vs to a holding capacitor line 56. Here, the "common electrode wiring 55" and the "holding capacitor line 56" configures an example of a "driving unit" according to an embodiment of the invention.

In addition, various signals are input to or output from the controller 10, the scanning line driving circuit 61, the data line driving circuit 62, and the common electrode modulating circuit 11. However, description of signals not particularly relating to this embodiment will be omitted.

Figure 17:
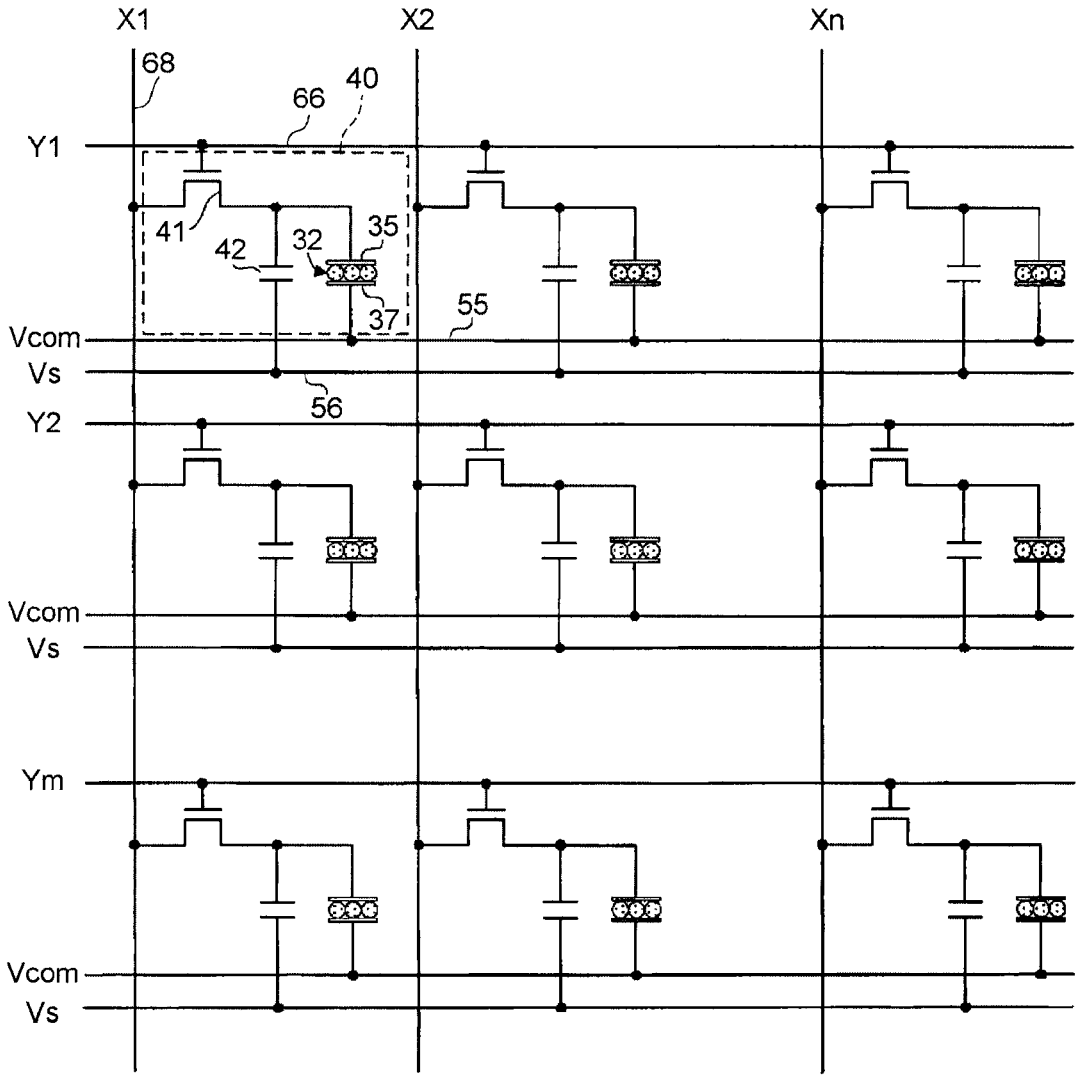
FIG. 17 is a diagram of a circuit configuration of a pixel.

FIG. 17 is a diagram showing the circuit configuration of the pixels. Next, the basic configuration of the pixel 40 of the electrophoretic display device 100 will be described with reference to FIG. 17.

As shown in FIG. 17, the pixel 40 includes a driving TFT 41, a pixel electrode 35, a common electrode 37, an electrophoretic element 32, and a holding capacitor 42.

The driving TFT 41, for example, is configured by an N-type transistor. The driving TFT 41 has the gate electrically connected to the scanning line 66, the source electrically connected to the data line 68, and the drain electrically connected to the pixel electrode 35 and the holding capacitor 42.

The driving TFT 41 outputs an image signal, which is supplied from the data line driving circuit 62 (see FIG. 16) through the data line 68, to the pixel electrode 35 and the holding capacitor 42 in accordance with a timing on the basis of a scanning signal that is supplied as a pulse from the scanning line driving circuit 61 (see FIG. 16) through the scanning line 66.

The image signal is supplied to the pixel electrode 35 from the data line driving circuit 62 through the data line 68 and the driving TFT 41. The pixel electrode 35 is disposed so as to face the common electrode 37 through the electrophoretic element 32.

The common electrode 37 is electrically connected to the common electrode wiring 55 to which the common electric potential Vcom is supplied.

The electrophoretic element 32 is configured by a plurality of microcapsules that is formed to include electrophoretic particles, respectively.

The holding capacitor 42 is configured by one pair of electrodes disposed to face each other through a dielectric film. One electrode of the holding capacitor 42 is electrically connected to the pixel electrode 35 and the driving TFT 41, and the other electrode of the holding capacitor 42 is electrically connected to the holding capacitor line 56. The image signal can be maintained for a predetermined period by the holding capacitor 42.

Driving Method

Next, the operation for updating a displayed image at the time of the operation of the electrophoretic display device 110 will be described. FIGS. 18A, 18B, 18C, and 18D are diagrams showing a rewriting operation of the electrophoretic display device according to this embodiment. FIGS. 18A to 18D correspond to FIGS. 9A to 9C. FIG. 19 is a timing chart showing voltages applied to the pixel electrode and the common electrode in a rewriting period according to this embodiment. FIG. 19 corresponds to FIG. 8. In addition, it is assumed that the electrophoretic particles include white electrophoretic particles that are negatively charged and black electrophoretic particles that are positively charged. In addition, it is assumed that "black" corresponds to the "first gray scale", and "white" corresponds to the "second gray scale".

Image Displaying Step

The driving method according to the second embodiment also includes the image displaying step S101, the image removing step S111, and the update image displaying step S121 that have been described with reference to FIG. 7.

Figure 18A:
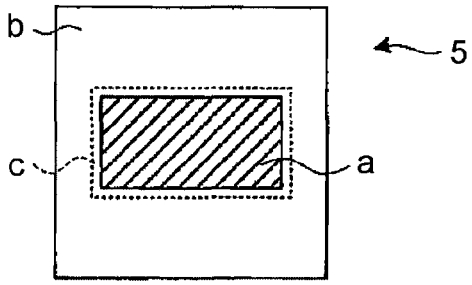
FIGS. 18A to 18D are diagrams showing a change in the displayed image at the time of image update.

In the state shown in FIG. 18A, a first diagram (image component) drawn in black on the white background in display unit 5 is shown as the first image. Here, in FIG. 18A, a black area is denoted by an area a, and a white area is denoted by an area b. In addition, prior to writing the first image, the white display is represented in the entire display unit 5. When the first image is written, as shown in FIG. 19, the common electric potential Vcom of the common electrode 37 becomes the low level. In addition, the electric potential Va of the pixel electrode 35 of the pixel 40 corresponding to the area a becomes the high level, and the electric potential Vb of the pixel electrode 35 of the pixel 40 corresponding to the area b (including an area c to be described later) becomes the low level.

Accordingly, the black electrophoretic particles move to the common electrode 37 side only in the area a, and the first image as shown in FIG. 18A is shown. After writing the first image, the common electrode 37 and all the pixel electrodes 35 become the low level, and whereby the display content (that is, the first image) is maintained.

In other words, in the image displaying step S101, image data on the basis of an image signal that defines the first image is written into each pixel, and accordingly, the first image is displayed in the display unit 5.

Image Removing Step

Figure 18B:
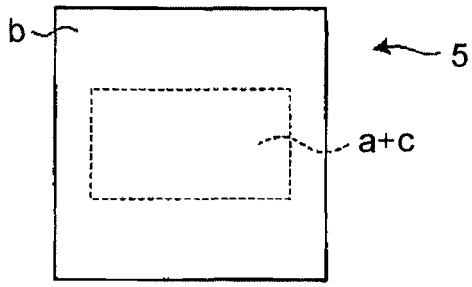

Next, before the displayed image is changed from the first image to the second image (see FIG. 18D to be described later), as shown in FIG. 18B, the white display is represented in the area a, and the area c that is an area of the area b that is adjacent to the area a and surrounds the area a, and whereby the first image is removed (the image removing step S111). At this moment, the common electrode 37 and the pixel electrode 35 of the pixel 40 corresponding to the area b (not including the area c) become the high level. In addition, the pixel electrodes 35 of the pixels 40 corresponding to the area a and the area c become the low level.

Accordingly, the black electrophoretic particles move to the pixel electrode 35 side only in the area a, and whereby the first diagram is removed. In addition, it is preferable that the width (that is, a distance between the outer edge of the area a and the outer edge of the area c) of the area c is a width corresponding to the size of one pixel.

In other words, in the image removing step S111, an area that includes the pixels of the area a forming the diagram (image component) of the black display and pixels of the area c that is disposed to be adjacent to pixels that form the contour of the image component (area a) and represents the white display is set as the image removing area. Then, the pixel constituting the image removing area is selectively changed to have the white display.

Figure 18C:
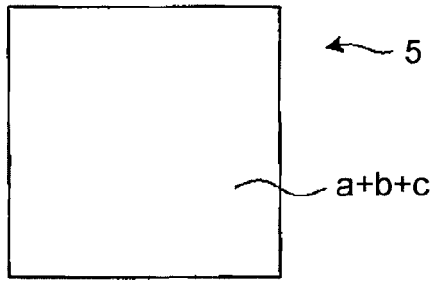

Next, as shown in FIG. 18C, the white display is represented in the entire display unit 5 (an entire removal step S112). At this moment, the common electrode 37 becomes the high level. On the other hand, the pixel electrodes 35 of all the pixels 40 become the low level. In addition, the entire removal step S112 is an independent step according to this embodiment. The entire removal step S112 is provided so as to relieve the excessive white display in the image removing step S111.

Update Image Displaying Step

Figure 18D:
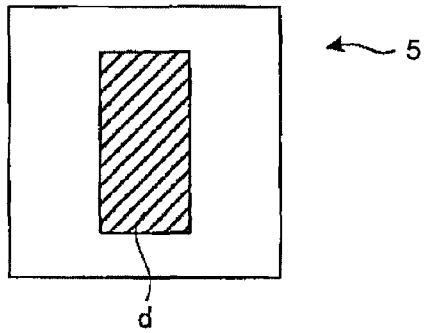

Next, as shown in FIG. 18D, a second diagram that is drawn in black on the white background in the display unit 5 as the second image is represented (the update image displaying step S121). Here, it is assumed that the black area is an area d in FIG. 18D. When the second image is written, the common electrode 37 becomes the low level. In addition, the pixel electrode 35 of the pixel 40 corresponding to the area d becomes the high level. In addition, the pixel electrodes 35 of the pixels 40 corresponding to an area of the display unit 5 other than the area d become the low level. Accordingly, the black electrophoretic particles move to the common electrode 37 side only in the area d, and accordingly, the second image as shown in FIG. 18D is displayed.

In other words, in the update image displaying step S121, image data on the basis of the image signal that defines the second image is written into each pixel, and accordingly, the second image is displayed in the display unit 5.

According to the driving method of the second embodiment described above, in order to remove the area a in which the black display is represented, an area acquired by adding the area c that surrounds the area a to the area a is removed as the image removing area in the image removing step. In other words, an area that includes the pixels of the area a that forms the diagram (image component) of the black display and the pixels of the area c disposed to be adjacent to the pixels forming the contour of the image component (area a) and which represent the white display is set as the image removing area, and the pixels constituting the image removing area are selectively changed to represent the white display.

Accordingly, even in the electrophoretic display device 110 that includes a pixel circuit including one driving TFT and the holding capacitor, the burn-in phenomenon that occurs in a boundary portion between the area a and the area c, that is, the afterimage formed along the contour of the area a, which has been described with reference to FIG. 11B, can be prevented.

In addition, in the image removing step, the image removal is performed for the area acquired by adding the area c to the area a as the image removing area. Accordingly, the power consumption can be suppressed, compared to a general driving method in which even the pixels having no change in display are driven for display.

As a result, according to this driving method, an image can be removed without generating the afterimage (burn-in phenomenon) while suppressing the power consumption.

FIG. 20 is a diagram showing an example of an image that is displayed in the display unit.

In addition, in FIG. 18, a case where the first diagram (image component) is a rectangle has been described as an example. However, when the diagram displayed in the display unit 5 has a ring shape as shown in FIG. 20, in the inversion removal of the image, the pixel electrodes 35 of the pixels 40 corresponding to an area a, an area c1 having a contour that is deviated by a predetermined width from the outer edge of the area a to a side (that is, the outer side) opposite to the area a, and an area c2 having the contour that is deviated by a predetermined width from the inner edge of the area a to a side (that is, the center side) opposite to the area a become the low level. In addition, the common electrode 37 becomes the high level.

Modified Example

Figure 21:
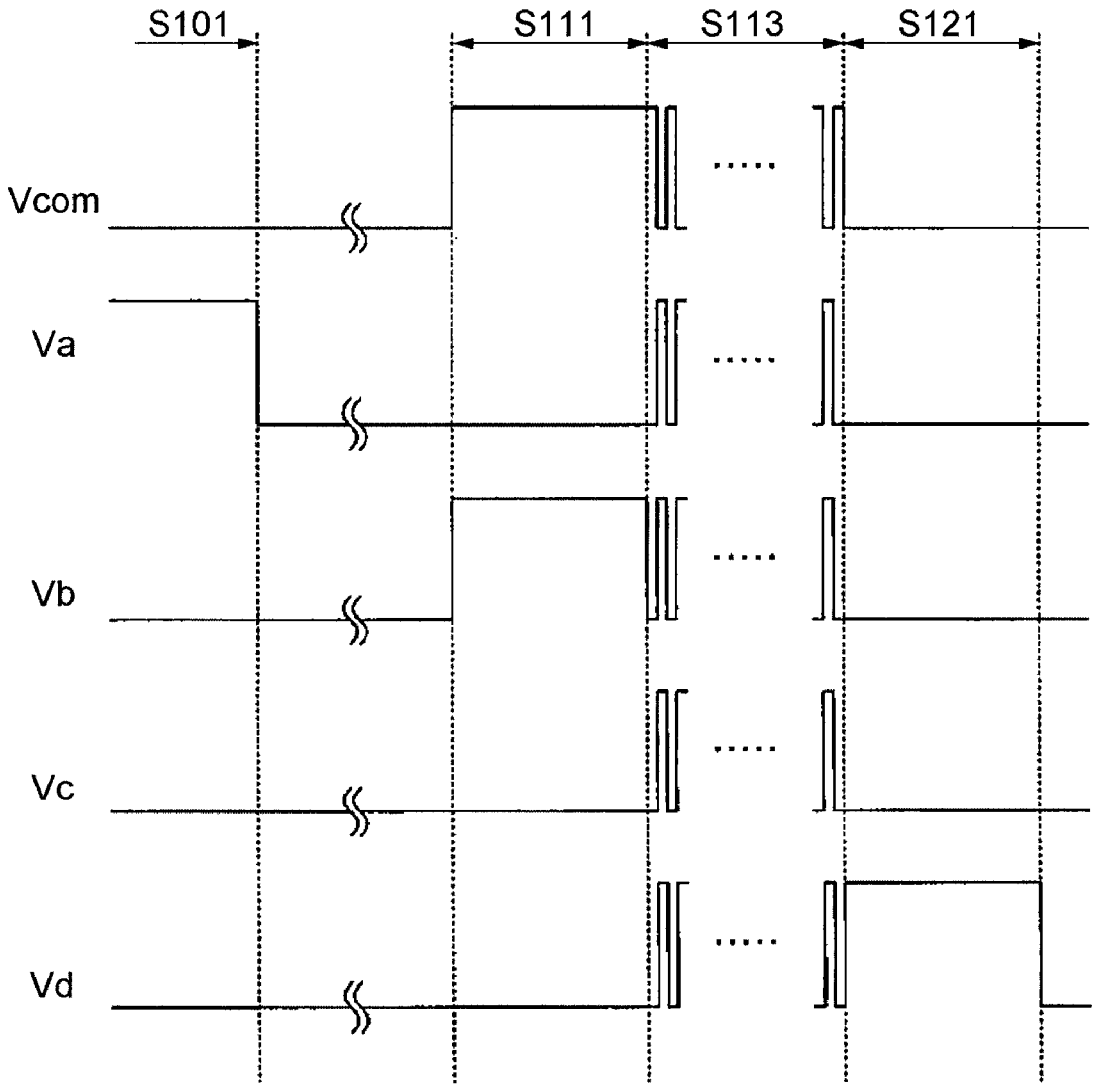
FIG. 21 is a timing chart of image update according to a modified example.

FIG. 21 is a timing chart showing voltages applied to the pixel electrode and the common electrode according to a modified example of the second embodiment. FIG. 21 corresponds to FIG. 19.

Next, the operation for updating a displayed image at the time of the operation of an electrophoretic display device according to the modified example of this embodiment will be described with reference to FIG. 21. FIG. 21 is a timing chart showing the voltages applied to the pixel electrode and the common electrode in a rewriting period according to the modified example of this embodiment. FIG. 21 corresponds to FIG. 19.

In this modified example, after the inversion removal period (the image removing step S111), instead of the entirely white removal period (the entire removal step S112), a removal period (removal step S113) in which the entirely white display and the entirely black display are repeatedly performed in a relatively short period is provided. In addition, it is preferable that repetition of the entirely white display and the entirely black display is performed in the period of one millisecond to ten milliseconds.

In the removal step S113, the entirely white display and the entirely black display are repeated in the relatively short period, and accordingly, the electrophoretic particles are agitated within the dispersion medium relatively well. Accordingly, a decrease in the afterimage generated at the time of image removal or a transient afterimage can be achieved.

Third Embodiment

Next, a driving method of an electrophoretic display device, according to a third embodiment of the invention will be described.

The driving method according to the third embodiment is a driving method in which the electrophoretic display device 100 described in the first embodiment is used. However, the driving method according to the third embodiment is different from that according to the first embodiment. In other words, in the third embodiment, only the driving method is different from that in the first embodiment. The configuration of the electrophoretic display device and the like other than the driving method are the same as those of the first embodiment.

In particular, the image removing step is configured by two steps of a partial removal step and an afterimage removing step, which is different from that of the first embodiment. Other driving steps are the same as those of the first embodiment on the whole.

Thus, parts of the third embodiment that are different from those of the first embodiment will be described in detail, and description of other configurations will be omitted appropriately. In addition, to each constituent part that is the same as that of the first embodiment, a same reference sign is attached for description.

Driving Method

Next, a driving method relating to image update of the electrophoretic display device 100 (FIG. 1) will be described. According to this embodiment, as an example, a driving method for a case where a square image is displayed, and then, update to a rectangular image having the horizontal side longer than the vertical side is made will be described.

Figure 22:
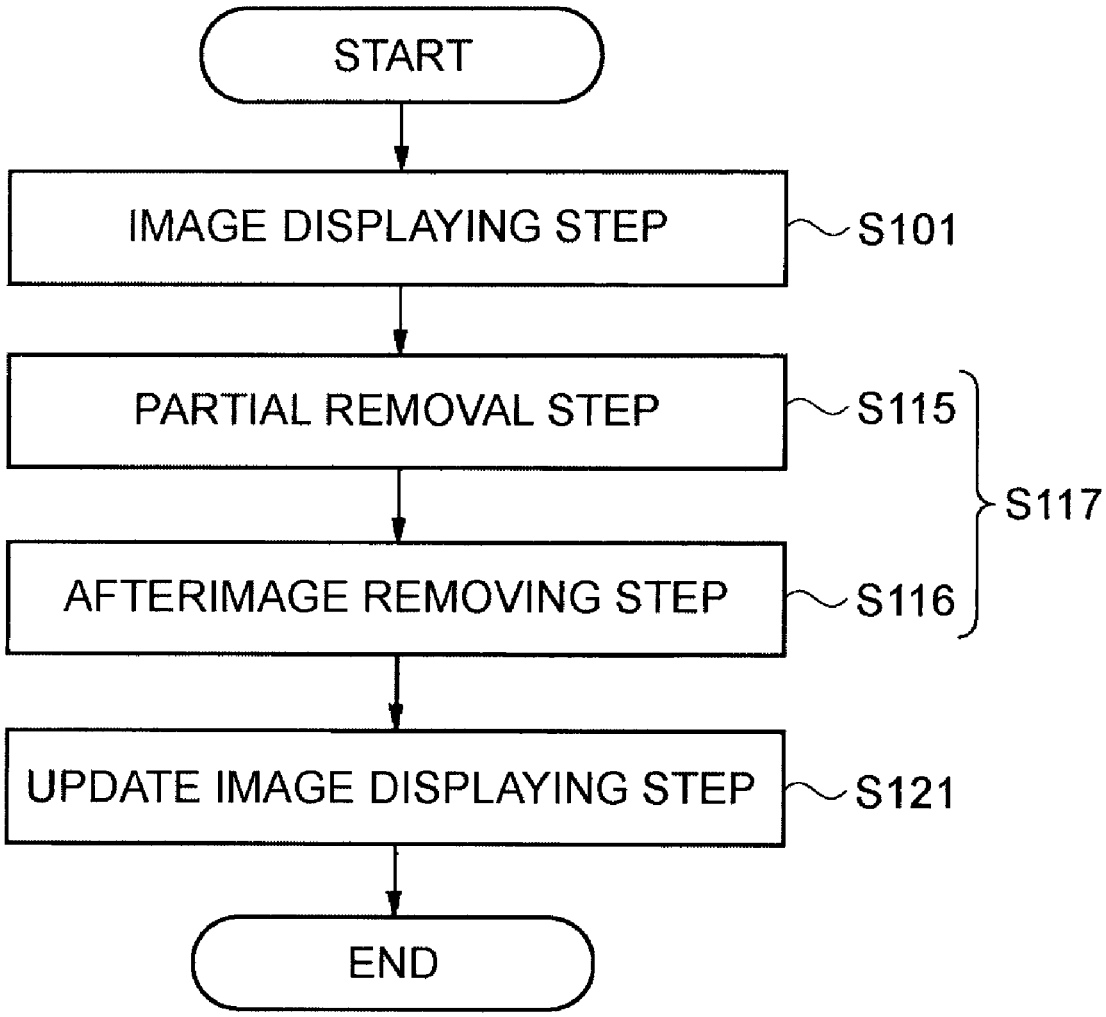
FIG. 22 is a flowchart of image update according to a third embodiment of the invention.

FIG. 22 is a flowchart relating to the image update. FIG. 22 corresponds to FIG. 7. As shown in FIG. 22, steps relating to the image update include an image displaying step S101, an image removing step S117, and an update image displaying step S121. The image removing step S117 includes a partial removal step S115 and an afterimage removing step S116.

Image Displaying Step

Figure 23:
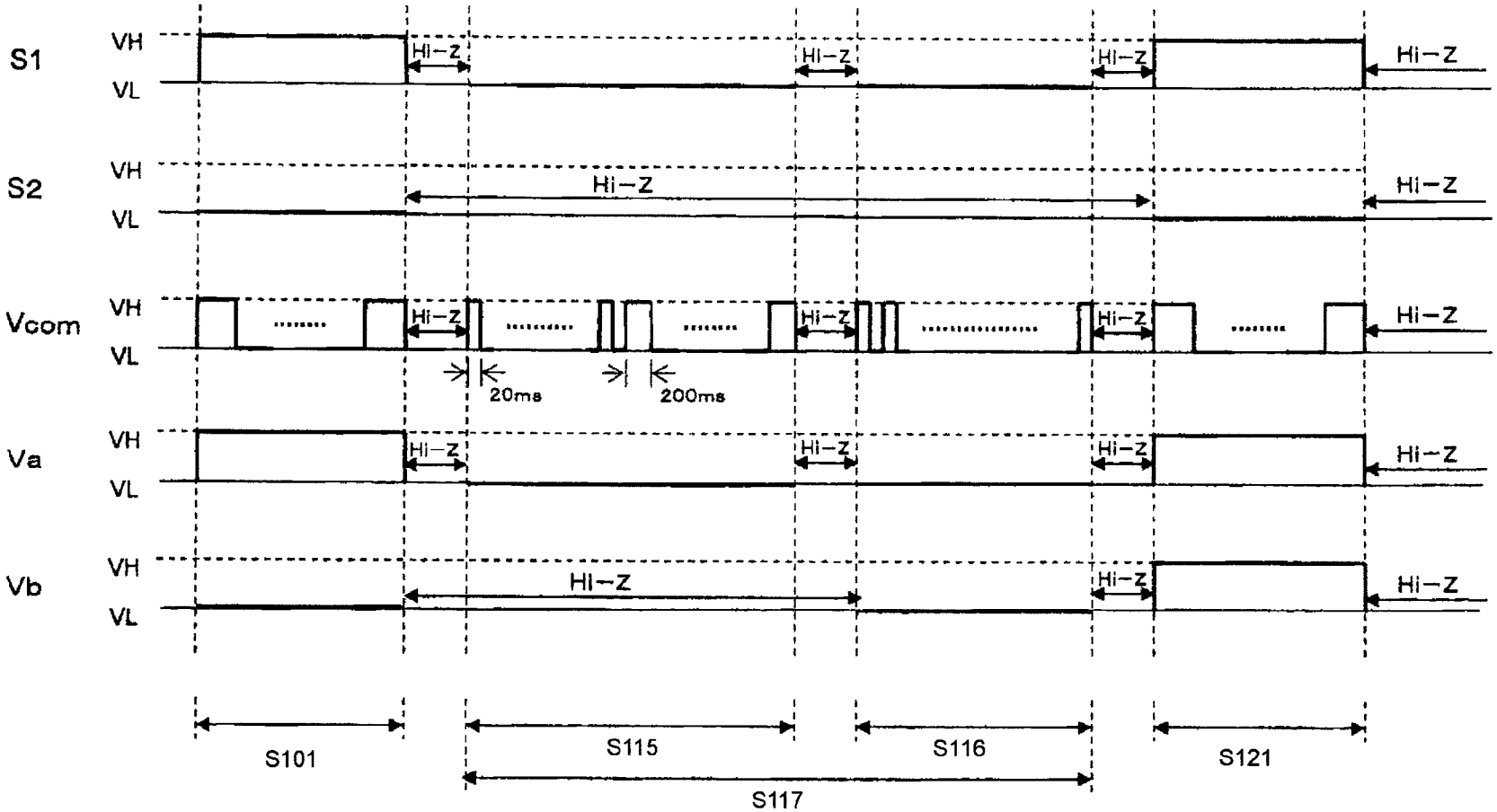
FIG. 23 is a timing chart relating to the image update.

First, the image displaying step S101 will be described. The image displaying step S101 is a step for displaying an image in the display unit 5. FIG. 23 is a timing chart relating to the image update according to this embodiment. FIG. 23 corresponds to FIG. 8. FIGS. 24A to 24D are diagrams showing a change in the displayed image at the time of the image update. FIG. 24A to FIG. 24D correspond to FIG. 9A to 9C. FIG. 25 is a diagram showing the relationship of electric potentials of pixels 40A and 40B in the image displaying step S101. FIG. 25 corresponds to FIG. 10.

In FIG. 23 and FIGS. 24A to 24D, a timing chart and changes in displayed images in the display unit 5 corresponding to the image displaying step S101 to the update image displaying step S121 are shown. In FIGS. 24A to 24D and FIG. 25, the pixel 40A is the pixel 40 that forms the contour of an image P1, and the pixel 40B is the pixel 40 that is disposed so as to be adjacent to the pixel 40A and forms the background. A combination of these pixels 40A and 40B may be selected arbitrarily. For example, although the pixels 40A and 40B shown in FIG. 25 are the pixels 40 belonging to a same scanning line 66, however, the pixels 40A and 40B may be the pixels 40 that belong to a same data line 68.

In addition, in FIGS. 23 and 25, subscripts "a" and "b" that are included in reference signs are attached only for the purpose of clearly identifying two pixels 40 (40A and 40B) to be described and constituent elements thereof. In description below, in a case where a pixel 40 located in a specific area is indicated, when any one of the pixels 40A and 40B is included in the specific area, the reference sign is added in a parenthesis such as "pixel 40 (40A)".

In FIG. 23, the electric potential S1 of the first control line 91, the electric potential S2 of the second control line 92, the electric potential Va of the pixel electrode 35*a*, the electric potential Vb of the pixel electrode 35*b*, and the electric potential Vcom of the common electrode 37 are shown. In FIGS. 24A to 24D, a part of the display unit 5 in which the image P1 is displayed is shown as extracted 8 pixels×8 pixels.

According to the driving method of this embodiment, before an image is displayed, image signals are input to the latch circuits 70 (70*a* and 70*b*) of the pixels 40 (40A and 40B).

As shown in FIG. 25, a high-level (H) image signal is input to the latch circuit 70*a* of the pixel 40A, in which the black display is represented by forming the image P1, from the data line 68*a* through the driving TFT 41*a*. On the other hand, a low-level (L) image signal is input to the latch circuit 70*b* of the pixel 40B, in which the white display is represented by forming the background, from the data line 68*b* through the driving TFT 41*b*.

When the image signals are input to the latch circuits 70*a* and 70*b*, the electric potential Vdd of the high-electric potential power source line 50 is set to the high level (VH) that is used for image display, and the electric potential Vss of the low-electric potential power source line 49 is set to a low level (VL). Accordingly, the electric potential of the data input terminal N1*a* of the pixel 40A becomes the high level (VH; Vdd), and the electric potential of the data output terminal N2*a* of the pixel 40A becomes the low level (VL; Vss). In addition, the electric potential of the data input terminal N1*b* of the pixel 40B becomes the low level (VL; Vss), and the electric potential of the data output terminal N2*b* of the pixel 40B becomes the high level (VH; Vdd).

Accordingly, when the image signals are input to the latch circuits 70*a*, and 70*b* of the pixels 40A and 40B, as shown in FIG. 23, the high-level electric potential VH is supplied to the first control line 91, and the low-level electric potential VL is supplied to the second control line 92.

In the pixel 40A to which the high-level (H) image signal is input, the electric potential of the data input terminal N1*a* becomes the high level (VH; Vdd), and the electric potential of the data output terminal N2*a* becomes the low level (VL; Vss). Accordingly, the transmission gate TG1*a* of the switching circuit 80*a* is in the ON state, and the high-level electric potential VH is supplied from the first control line 91 to the pixel electrode 35*a*.

On the other hand, in the pixel 40B to which the low-level (L) image signals are input, the electric potential of the data input terminal N1*b* becomes the low level (L), and the electric potential of the data output terminal N2*b* becomes the high level (H). Accordingly, the transmission gate TG2*b* of the switching circuit 80*b* is in the ON state, and the low-level electric potential VL is input from the second control line 92 to the pixel electrode 35*b*.

In addition, a pulse-shaped signal in which a period of the high level (VH) and a period of the low level (VL) are periodically repeated is input to the common electrode 37.

In such a case, an electric potential difference between the pixel electrode 35*a* and the common electrode 37 is applied to the electrophoretic element 32 during the period in which the common electrode 37 is the low level (VL). Accordingly, as shown in FIG. 5B, the positively charged black particles 26 are attracted to the common electrode 37 side, and the negatively charged white particles 27 are attracted to the pixel electrode 35*a* side. Therefore, during the above-described period, the black display is represented by the pixel 40A, and a square image P1 shown in FIG. 24A is displayed. In addition, an electric potential difference between the pixel electrode 35*b* and the common electrode 37 is applied to the electrophoretic element 32 during the period in which the common electrode 37 is the high level (VH). Accordingly, as shown in FIG. 5A, the negatively charged white particles 27 are attracted to the common electrode 37 side, and the positively charged black particles 26 are attracted to the pixel electrode 35*b* side. Therefore, during the above-described period, the white display is represented by the pixel 40B, and the background is formed.

When the square image P1 is displayed, the first control line 91, the second control line 92, and the common electrode 37 are electrically disconnected from each other by the common power source modulating circuit 64 to be in the high-impedance state. In addition, the pixel electrodes 35 (35*a* and 35*b*) to which the voltages are supplied from the first control line 91 and the second control line 92 are also in the high-impedance state. On the other hand, the latch circuits 70 (70*a* and 70*b*) are driven, and the input image signals are stored therein.

Image Removing Step

Next, the image removing step S117 will be described. As shown in FIG. 22, the image removing step S117 includes a partial removal step S115 and an afterimage removing step S116.

Partial Removal Step

Figure 25:
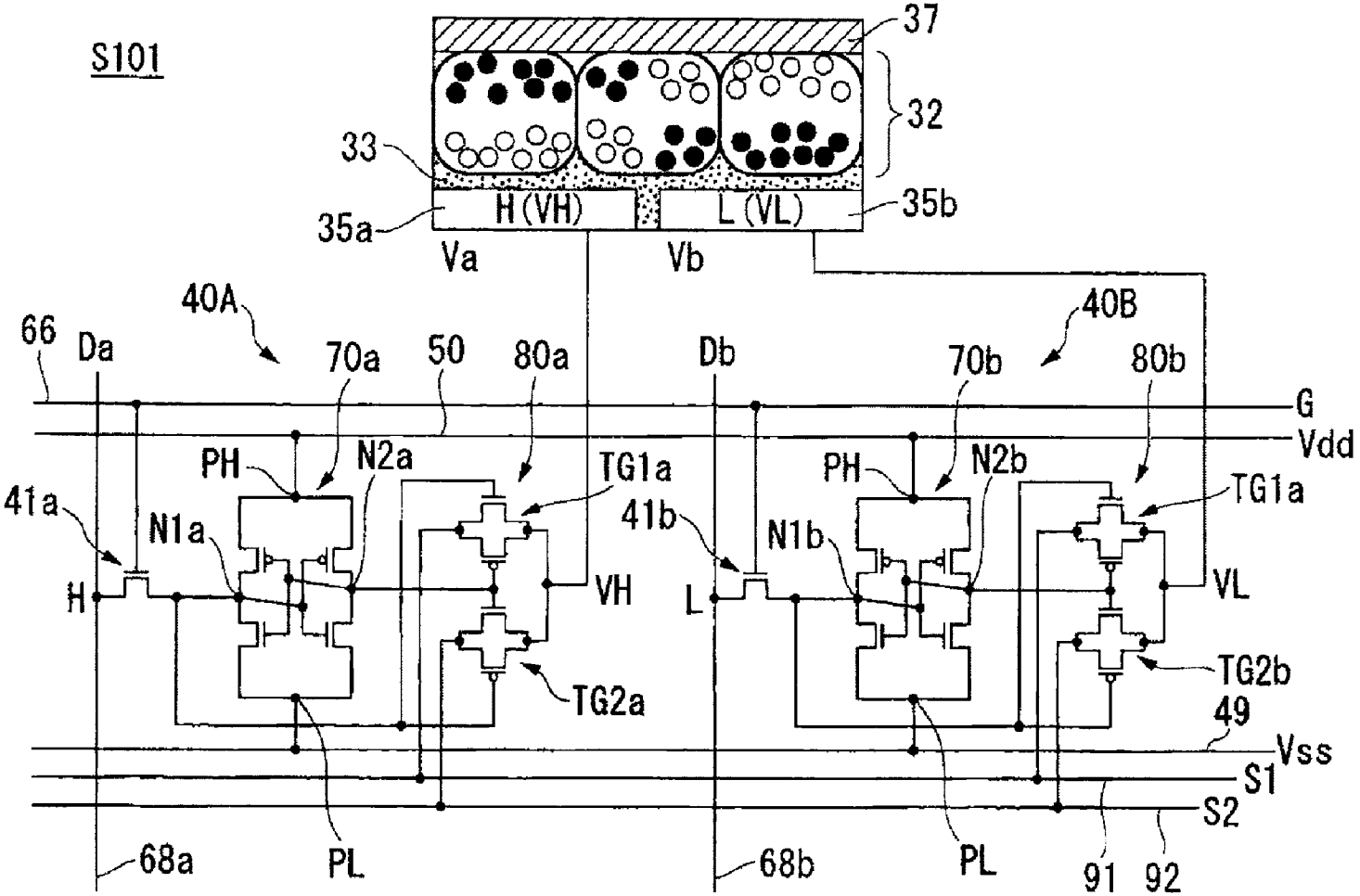
FIG. 25 is a diagram showing the relationship of electric potentials of pixels in an image displaying step.
Figure 26:
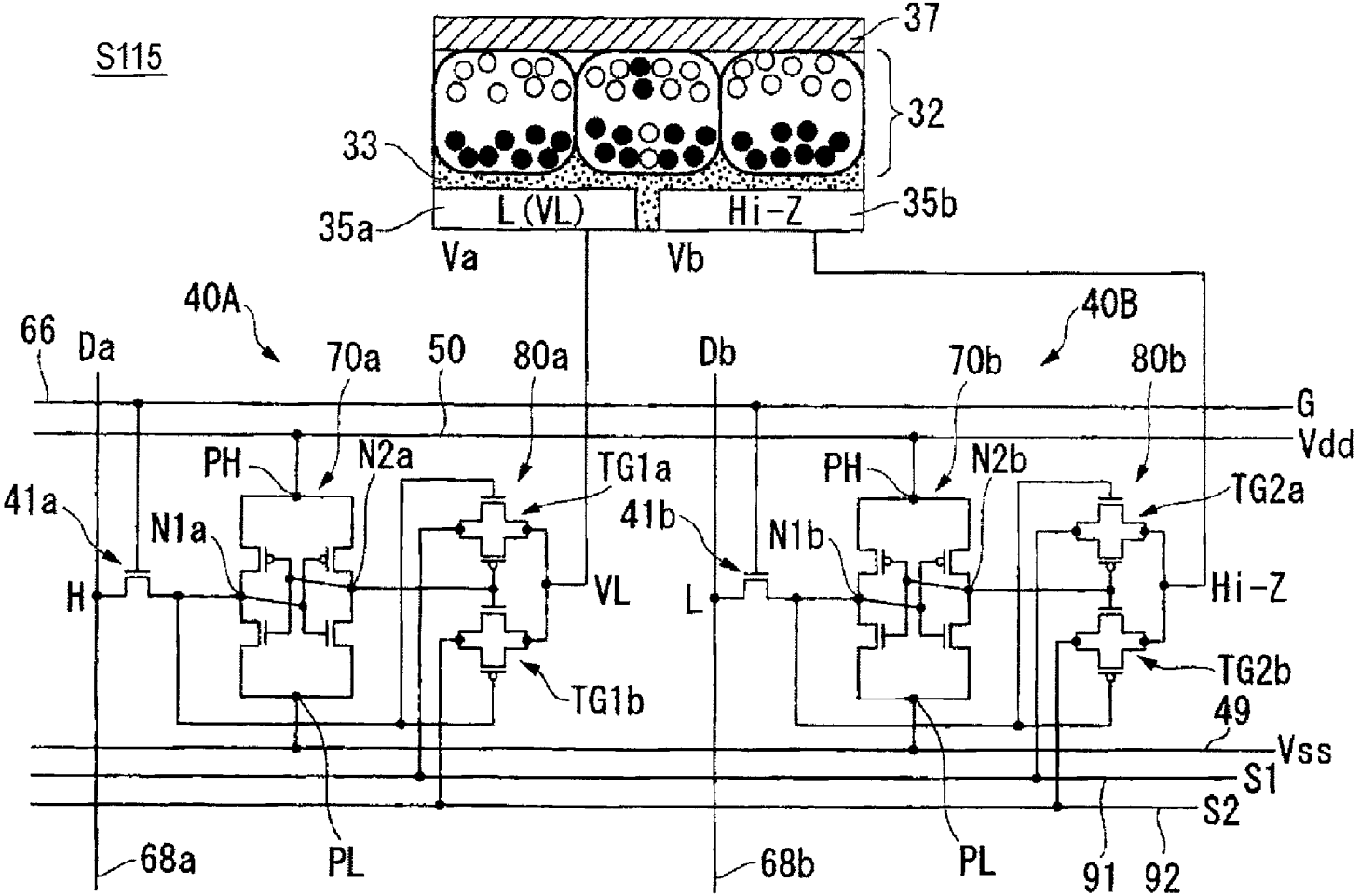
FIG. 26 is a diagram showing the relationship of electric potentials of pixels in a partial removal step.

First, the partial removal step S115 will be described. The partial removal step S115 is a step for removing the image P1 by driving only the pixel 40 (40A) in which the black display is represented by forming the image P1. FIG. 26 is a diagram showing the relationship of electric potentials of the pixels 40A and 40B relating to the partial removal step S115. FIG. 26 is a diagram corresponding to FIG. 25. To each constituent element shown in FIG. 26 that is common to FIG. 25, a same reference sign is attached.

In the partial removal step S115, a low-level electric potential VL is supplied to the first control line 91, and a pulse-shaped signal in which a period of the high level (VH) and a period of the low level (VL) are periodically repeated is input to the common electrode 37. On the other hand, the second control line 92 is in the high impedance state.

As described above, even after the square image P1 is displayed in the image displaying step S101, the image signals input to the pixels 40 (40A and 40B) are stored in the latch circuits 70 (70*a* and 70*b*). Accordingly, in the pixel 40 (40A), in which a high-level image signal is input to the latch circuit 70*a*, for forming the image P1, the transmission gate TG1 (TG1*a*) is in the ON state. On the other hand, in the pixel 40 (40B), in which a low-level image signal is input to the latch circuit 70*b*, for forming the background, the transmission gate TG2 (TG2*b*) is in the ON state.

Accordingly, in the partial removal step S115, the pixel electrode 35 (35*a*) of the pixel 40 (40A) that forms the image P1 is connected to the first control line 91 and is supplied with the low-level electric potential VL. On the other hand, the pixel electrode 35 (35*b*) of the pixel 40 (40B) that forms the background is connected to the second control line 92 so as to be in the high-impedance state.

Then, an electric potential difference between the pixel electrode 35 (35*a*) of the pixel 40 (40A) that forms the image P1 and the common electrode 37 is applied to the electrophoretic element 32 during a period in which the high-level (VH) is supplied to the common electrode 37. Accordingly, the white display is represented by the pixel 40 (40A) that forms the image P1, and the image P1 is removed as shown in FIG. 24B. On the other hand, the pixel electrode 35 (35*a*) and the common electrode 37 have the same electric potential in a period in which the low level (VL) is supplied to the common electrode 37, there is little influence on the movement of the black particles 26 and the white particles 27.

Here, for example, the signal that is input to the common electrode 37 is a pulse, of which the high-level electric potential VH is 15 V, the low-level electric potential VL is 0 V, and the pulse width and the number of the pulses are 20 ms×30 pulses+200 ms×4 pulses. Accordingly, the time interval of application of a voltage for the electrophoretic element 32 is 1.4 s, and a value acquired by multiplying a voltage by the time interval of application of the voltage is 15 V×1.4 s=21 V·s.

On the other hand, the pixel electrode 35 (35*b*) of the pixel 40 (40B) that forms the background is in the high-impedance state, and the pixel 40 (40B) is not driven in the partial removal step S115. Accordingly, even when a pulse is input to the common electrode 37, there is little influence on the movement of the black particles 26 and the white particles 27, and whereby the white display is maintained in the background. A signal that is the same as the pulse input to the common electrode 37 may be configured to be input to the second control line 92. In such a case, the pixel electrode 35 (35*b*) of the pixel 40 (40B) that forms the background and the common electrode 37 have a same electric potential, and there is little influence on the movement of the black particles 26 and the white particles 27, and whereby the white display can be maintained in the background.

When the image P1 is removed as described above, the partial removal step S115 is completed.

However, when the image P1 is selectively removed in the partial removal step S115, as shown in FIG. 24B, an afterimage P2 remains along the contour of the image P1. The afterimage P2 is generated in an area near a boundary between the pixel 40 (40A) that forms the contour and the pixel 40 (40B) that is disposed so as to be adjacent to the pixel 40 (40A) and forms the background.

As shown in FIGS. 23 and 26, when the image P1 is displayed in the image displaying step S101, the high-level (VH) electric potential is supplied to the pixel electrode 35 (35*a*) of the pixel 40 (40A) that forms the image P1, and the low-level (VL) electric potential is supplied to the common electrode 37. At this moment an electric field is generated in the diagonal direction from the pixel electrode 35 (35*a*) of the pixel 40 (40A) that forms the image P1 toward the common electrode 37 located on the background side. In accordance with the diagonal electric field, the black display is also represented in an area near the boundary between the image P1 and the background, and accordingly, the contour portion of the image P1 is slightly raised.

Then, when the image P1 is removed in the partial removal step S115, only the raised contour remains so as to be the afterimage P2.

Thus, according to this embodiment, the afterimage P2 is removed in the afterimage removing step S116 described below.

Afterimage Removing Step

The afterimage removing step S116 is a step for removing the afterimage P2. In the afterimage removing step S116, after an afterimage removing area for afterimage removal is set, and the pixels 40 forming the afterimage removing area are driven so as to remove the afterimage P2.

Figure 27:
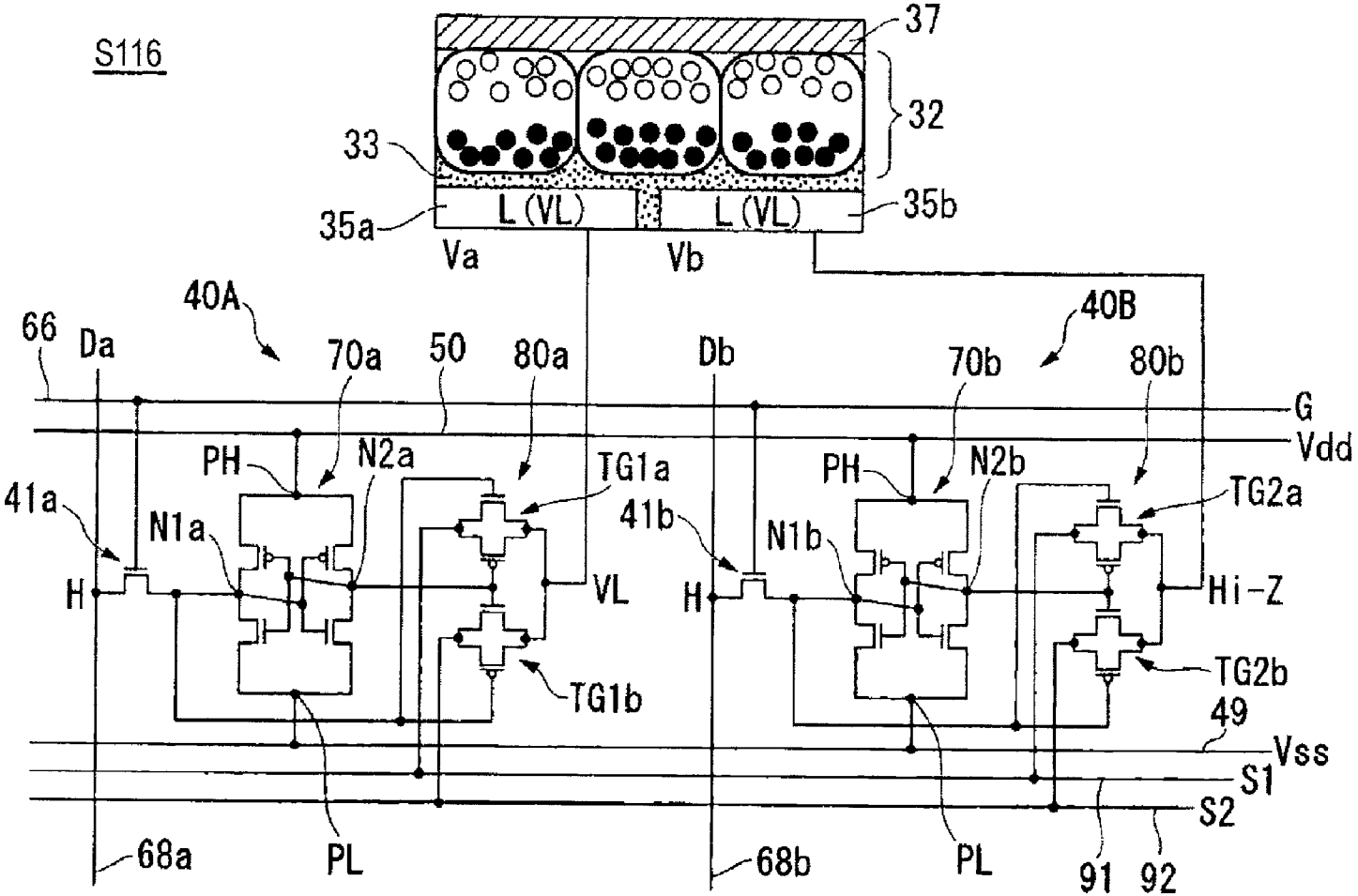
FIG. 27 is a diagram showing the relationship of electric potentials of pixels in an afterimage removing step.
Figure 28:
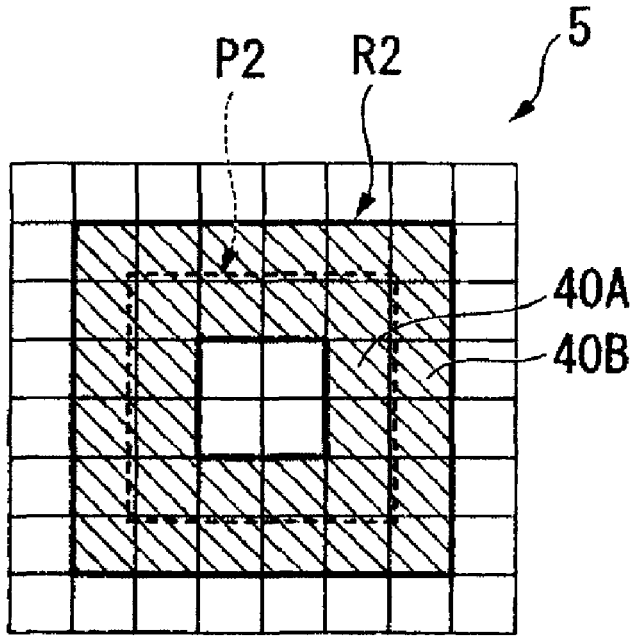
FIG. 28 is a diagram showing an afterimage removing area R2.

FIG. 27 is a diagram showing the relationship of electric potentials in the afterimage removing step S116. FIG. 27 is a diagram showing the relationship of the electric potentials of the pixels 40A and 40B in the afterimage removing area. FIG. 27 is a diagram corresponding to FIGS. 25 and 26. To each constituent element shown in FIG. 27 which is common to FIG. 25 or 26, a same reference sign is attached. In FIG. 28, the afterimage P2 and the afterimage removing area R2 are shown.

Here, a method of setting the afterimage removing area R2 will be described. The afterimage removing area setting circuit 167 (FIG. 6) extracts the pixel 40 (40A) that forms the contour of the image P1 from the image data D that is expanded in the frame memory 165. Then, the pixel 40 (40B), which is disposed to be adjacent to the pixel 40 (40A) that forms the contour, of the pixels 40 (40B) forming the background is extracted. These pixels 40 (40A and 40B), for example, are extracted by using a general technique that is employed by image processing software.

Then, the afterimage removing area setting circuit 167 sets an area, which is formed by the pixel 40 (40A) forming the contour and the pixel 40 (40B) that is disposed to be adjacent to the contour so as to form the background, having a width corresponding to two pixels as the afterimage removing area R2. The afterimage P2 is included in the set afterimage removing area R2.

The pixel information that configures the afterimage removing area R2 is output from the afterimage removing area setting circuit 167 to the control circuit 161, and image data D for afterimage removal is generated based on the pixel information by the control circuit 161. The image data D for afterimage removal that is generated by the control circuit 161 is expanded into the frame memory 165, and then is input to the latch circuit 70 of each pixel 40. According to this embodiment, the pixels 40 (40A and 40B) that form the afterimage removing area R2 are extracted from the image data D after being developed into the frame memory 165. However, these pixels 40 (40A and 40B) may be configured to be extracted by analyzing the image data D before expansion by using the control circuit 161. In such a case, the process from extracting the pixels 40 (40A and 40B) that form the afterimage removing area R2 to generation of the image data D for afterimage removal is consistently performed by the control circuit 161.

Figure 29:
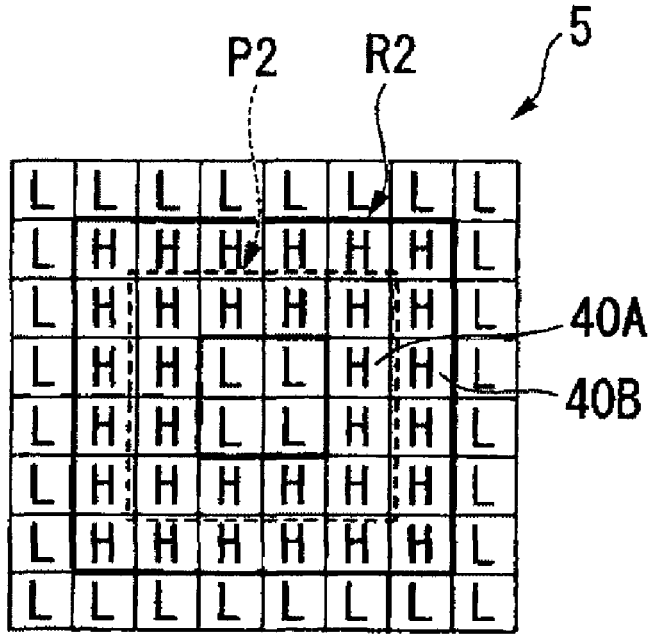
FIG. 29 is a diagram showing image signals in correspondence with a display unit.

FIG. 29 is a diagram showing image signals input at the time of afterimage removal in correspondence with the display unit 5. As shown in FIG. 29, the high-level (H) image signals are input to the latch circuits 70 (70*a* and 70*b*) of the pixels 40 (40A and 40B) that form the afterimage removing area R2. The high-level (H) image signals cover the afterimage P2 in a width corresponding to two pixels with the afterimage P2 interposed therebetween. In addition, low-level (L) image signals are input to the latch circuits 70 of other pixels 40. The low-level (L) image signals are input to the pixels 40 that form the background and the pixels 40 that form a center portion (a portion other than the contour) of the image P1.

When the image signal is input to the latch circuit 70, the electric potentials of the high-electric potential power source line 50 and the low-electric potential power source line 49 are set to the electric potentials (VH and VL) for image display.

When the image signals for afterimage removal is input as described above, the transmission gates TG1 (TG1*a* and TG1*b*) of the pixels 40 (40A and 40B) to which the high-level (H) image signals are input are in the ON state. On the other hand, the transmission gate TG2 of the pixel 40 to which the low-level (L) image signal is input is in the ON state. In addition, as shown in FIG. 23, the low-level electric potential (VL) is supplied to the first control line 91, and the second control line 92 is in the high-impedance state. A pulse shaped signal in which a period of the high level (VH) and a period of the low level (VL) are repeated is supplied to the common electrode 37.

The pixel electrodes 35 (35*a* and 35*b*) of the pixels 40 (40A and 40B) having the latch circuits 70 to which the high-level (H) image signals are input are connected to the first control line 91 and are supplied with the low-level (VL) electric potential. On the other hand, the pixel electrode 35 of the pixel 40 having the latch circuit 70 to which the low-level (L) image signal is input is connected to the second control line 92 and is in the high-impedance state.

Accordingly, in the pixels 40 (40A and 40B) to which the high-level (H) image signals are input, a voltage corresponding to an electric potential difference between the pixel electrodes 35 (35*a* and 35*b*) and the common electrode 37 are applied to the electrophoretic element 32 during a period in which the high-level (VH) electric potential is supplied to the common electrode 37. Accordingly, in the afterimage removing area R2, the black particles 26 move to the pixel electrode 35 side, and the white particles 27 move to the common electrode 37 side, whereby the afterimage P2 is removed.

During a period in which the low-level (VL) electric potential is supplied to the common electrode 37, the pixel electrodes 35 (35*a* and 35*b*) and the common electrode 37 have a same electric potential, and accordingly, there is little influence on the movement of the black particles 26 and the white particles 27. On the other hand, in the pixel 40 to which the low-level (L) image signal is input, the pixel electrode 35 is in the high-impedance state. Accordingly, even when a pulse is supplied to the common electrode 37, there is little influence on the movement of the black particles 26 and the white particles 27, and whereby the white display is maintained.

Figure 24C:
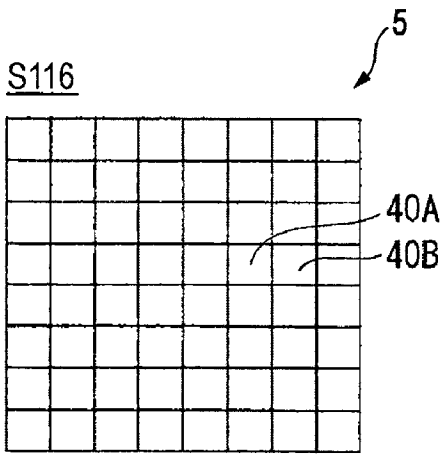
FIGS. 24A to 24D are diagrams showing a change in the displayed image at the time of image update.
Figure 24B:
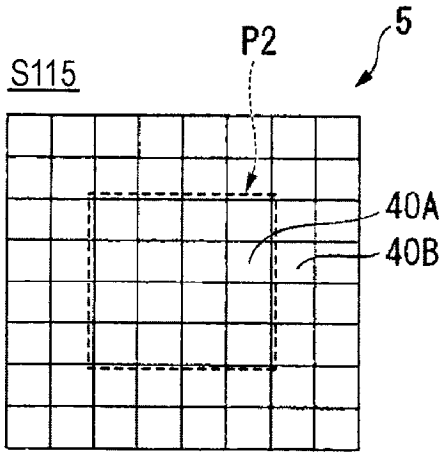
Figure 24A:
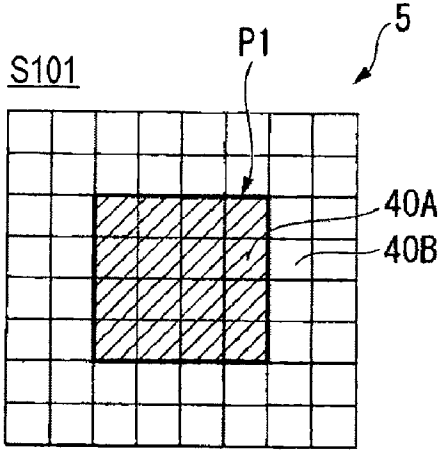

Accordingly, as shown in FIG. 24C, when the afterimage P2 is removed, the white display is represented over the entire area of the display unit 5. In addition, a signal that is the same as the pulse supplied to the common electrode 37 may be configured to be input to the second control line 92 in the afterimage removing step S116. In such a case, in the pixel 40 to which the low-level image signal is input, the pixel electrode 35 and the common electrode 37 have the same electric potential. Accordingly, there is little influence on the movement of the black particles 26 and the white particles 27, and whereby the white display is maintained.

In the afterimage removing step S116, the frequency and the number of the pulses input to the common electrode 37 are set such that the balance of the electric potential of the electrophoretic element 32 is maintained over the entire area of the display unit 5 while removing the afterimage P2. The above-described setting of the pulse condition is not for generating unevenness in the displayed image (P1). In addition, under such a pulse condition, there is an advantage that a color change or corrosion of the common electrode 37 can be prevented.

In particular, the pulse condition is set such that a value acquired by multiplying a voltage applied to the electrophoretic element 32 by a time interval of application of the voltage in the afterimage removing step S116 is smaller than a value acquired by multiplying a voltage applied to the electrophoretic element 32 by a time interval of application of the voltage in the partial removal step S115.

Here, for example, the signal that is input to the common electrode 37 in the afterimage removing step S116 is a pulse of which the high-level electric potential (VH) is 15 V, the low-level electric potential (VL) is 0 V, and the pulse width and the number of the pulses are 20 ms×6 pulses. Accordingly, the time interval of application of the voltage for the electrophoretic element 32 is 0.12 s, and the value acquired by multiplying the voltage by the time interval of application of the voltage is 15 V×0.12 s=1.8 V·s. This value is smaller than the value of 21 V·s that is acquired by multiplying the voltage by the time interval of application of the voltage in the partial removal step S115.

When the afterimage P2 is removed, as shown in FIG. 23, the first control line 91, the second control line 92, and the common electrode 37 are in the high-impedance state, and the process proceeds to the update image displaying step S121.

Update Image Displaying Step

Figure 24D:
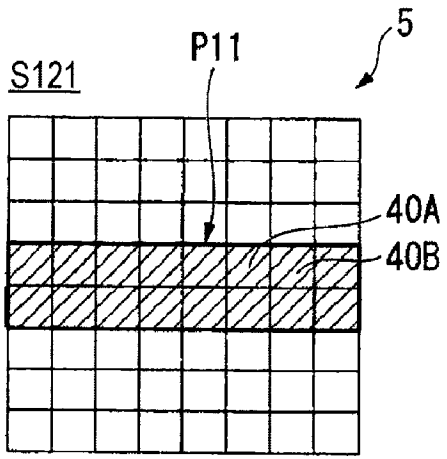
Figure 30:
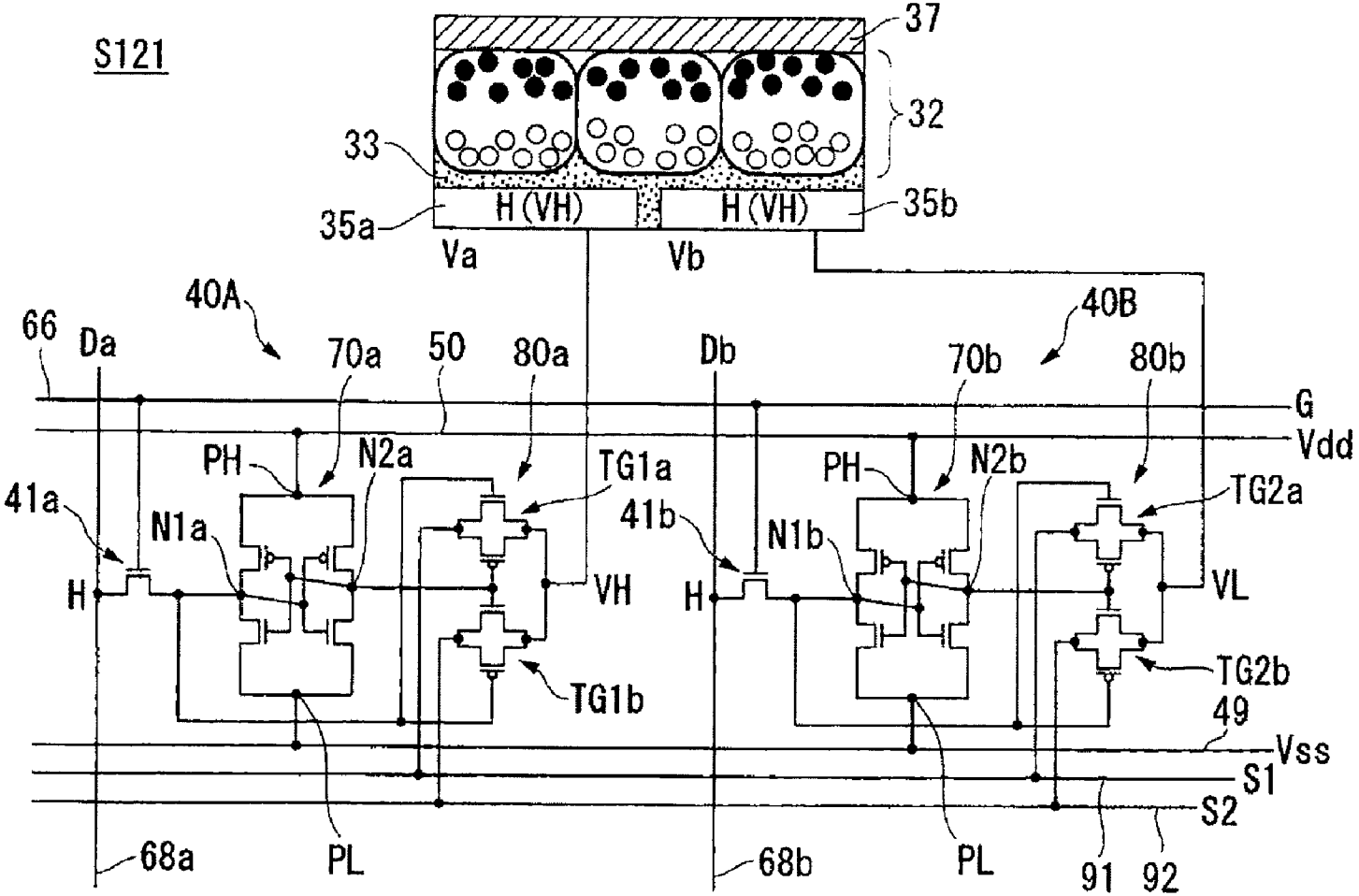
FIG. 30 is a diagram showing the relationship of electric potentials of pixels in an update image displaying step.

The update image displaying step S121 is a step for displaying an update image P11 shown in FIG. 24D. In the update image displaying step S121, the driving operation is the same as that in the image displaying step S101 after the image signals for image update are input to the pixels 40. FIG. 30 is a diagram showing the relationship of the electric potentials of the pixels 40A and 40B in the update image displaying step S121. FIG. 30 is a diagram corresponding to FIGS. 25 to 27. To each constituent element shown in FIG. 30 which is common to FIGS. 25 to 27, a same reference sign is attached.

When the process proceeds to the update image displaying step S121, the image data D for image update is output from the control circuit 161 (FIG. 6) to the frame memory 165. Then, after the image data D is expanded in the frame memory 165 as an image signal for each pixel 40, the image signal is input to the latch circuit 70 of each pixel 40.

Both the pixels 40A and 40B are pixels 40 that form the update image P11, and accordingly, as shown in FIG. 30, the high-level (H) image signals are input to the latch circuits 70*a* and 70*b* of the pixels 40A and 40B.

The transmission gates TG1 (TG1*a* and TG1*b*) of the pixels 40 (40A and 40B) having the latch circuits 70, to which the high-level (H) image signals are input, are in the ON state. On the other hand, the transmission gate TG2 of the pixel 40 having the latch circuit 70 to which the low-level (L) image signal is input is in the ON state.

When the image signals are input to the latch circuits 70, the electric potentials (Vdd and Vss) of the high-electric potential power source line 50 and the low-electric potential power source line 49 are set to the electric potentials (VH and VL) for image display. Then, as shown in FIG. 23, the high-level electric potential (VH) is supplied to the first control line 91, and the low-level electric potential (VL) is supplied to the second control line 92. In addition, a pulse-shaped signal in which a period of the high level (VH) and a period of the low level (VL) are repeated is supplied to the common electrode 37.

The pixel electrodes 35 (35*a* and 35*b*) of the pixels 40 (40A and 40B) having the latch circuits 70 to which the high-level (H) image signals are input are connected to the first control line 91 and are supplied with the high-level (VH) electric potentials.

On the other hand, the pixel electrode 35 of the pixels 40 having the latch circuit 70 to which the low-level (L) image signal is input is connected to the second control line 92 and is supplied with the low-level (VL) electric potential.

Accordingly, the black display is represented by the pixels 40 (40A and 40B) to which the high-level (H) image signals are input, and the update image P11, shown in FIG. 24D, having a rectangle shape of which the horizontal side is longer than the vertical side is displayed. In addition, the white display is represented by the pixel 40 to which the low-level (L) image signal is input, and the background of the update image P11 is displayed. As shown in FIG. 24D, any afterimage P2 of the previous image P1 does not remain in the display unit 5, and only the image P11 is displayed.

When the rectangular image P11 is displayed, the first control line 91, the second control line 92, and the common electrode 37 are in the high-impedance state, and the update image displaying step S121 is completed. When the image is to be updated consecutively, the image removing step S117 and the update image displaying step S121 are repeatedly performed.

According to the driving method of the third embodiment, the following advantages can be acquired.

First, when the afterimage P2 is removed in the afterimage removing step S116, only the pixels 40 (40A and 40B) that form the afterimage removing area R2 are driven. Accordingly, the afterimage P2 can be removed while suppressing the power consumption. According to this embodiment, the afterimage removing area R2, which is configured by the pixel 40 (40A) that forms the contour and the pixel 40 (40B) that is disposed to be adjacent to the pixel 40 (40A) and forms the background, having a width corresponding to two pixels is set. Accordingly, the number of the pixels driven in the afterimage removing step S116 becomes a minimum. Therefore, the afterimage can be removed while suppressing the power consumption further.

In addition, when the image P1 is removed in the partial removal step S115, an electric potential is supplied to the pixel electrode 35 (35*a*) of the pixel 40 (40A) that forms the image P1, and the pixel electrode 35 of the pixel 40 that forms the background is in the high-impedance state. Accordingly, the image P1 is selectively removed by driving only the pixel 40 (40A) that forms the image P1. Therefore, the image P1 can be removed while suppressing the power consumption, compared to a case where the previous screen is removed.

In addition, it is preferable that the width of the afterimage removing area R2 is set in accordance with the form of generation of the afterimage that is different depending on the characteristics of the electrophoretic element 32.

For example, the afterimage removing area R2 may be an area that has a width corresponding to three or more pixels by broadening the area to the background side or the image side. In such a case, the number of the pixels to be driven is increased, and the advantage from the viewpoint of the power consumption is degraded. However, in such a case, the pixels 40 in the broader range are driven, and accordingly, generation of the afterimage P2 can be prevented more assuredly. In addition, the afterimage removing area R2 may be an area that is formed of only the pixels located on the background side without including any pixel located on the image side. In such a case, the afterimage removing area R2 can be set as a minimum area that is necessary for removing the afterimage P2, and accordingly, the power consumption can be suppressed.

In addition, by setting a value acquired by multiplying a voltage applied to the electrophoretic element 32 by a time interval of the application of the voltage in the afterimage removing step S116 to be smaller than a value acquired by multiplying a voltage of the pulse applied to the electrophoretic element 32 by a time interval of application of the voltage in the partial removal step S115, the balance of the electric potential of the electrophoretic element 32 is uniformly maintained over the entire area of the display unit 5. Accordingly, generation of unevenness in the displayed image (P1 and P11) and a color change or corrosion of the common electrode 37 can be prevented.

Electronic Apparatus

Next, the cases in which the electrophoretic display device 100, according to each of the above-described embodiments, is applied to an electronic apparatus will be described.

Figure 31:
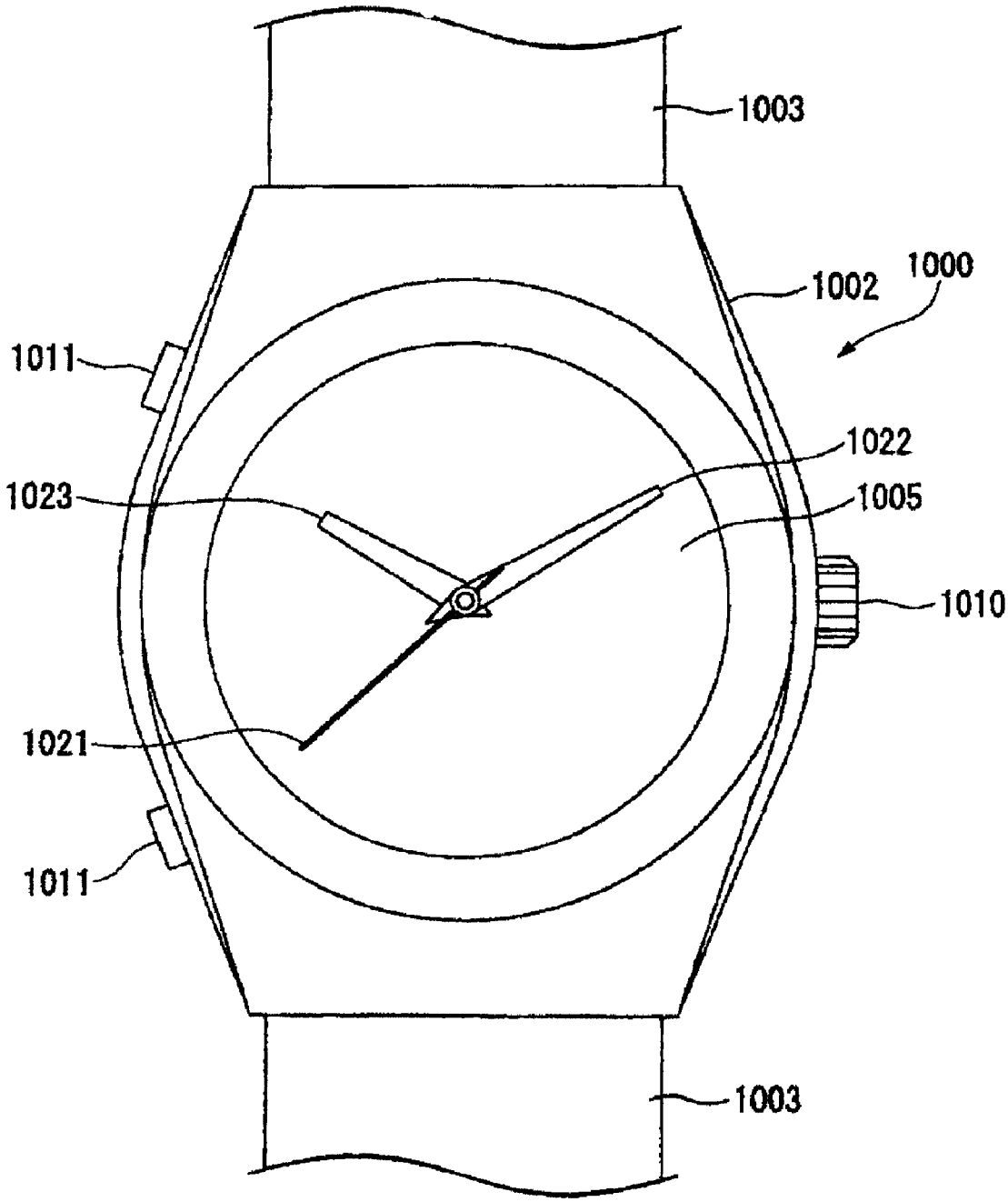
FIG. 31 is a front view of a wrist watch as an electronic apparatus according to an embodiment of the invention.

FIG. 31 is a front view of a wrist watch 1000. The wrist watch 1000 includes a watch case 1002 and a pair of bands 1003 connected to the watch case 1002.

In the front side of the watch case 1002, a display unit 1005 that is configured by the electrophoretic display device 100 according to each of the above-described embodiments, a second hand 1021, a minute hand 1022, and an hour hand 1023 are disposed. In addition, on the side of the watch case 1002, a winder 1010 as an operator, and an operation button 1011 are disposed. The winder 1010 is connected to a hand setting stem (not shown) disposed inside the case and is provided such that the winder, together with the hand setting stem, can be pushed or pulled at multiple levels (for example, two levels) and rotated. In the display unit 1005, an image that becomes the background, a character string such as date, time, or the like, a second hand, a minute hand, an hour hand, and the like can be displayed.

Figure 32:
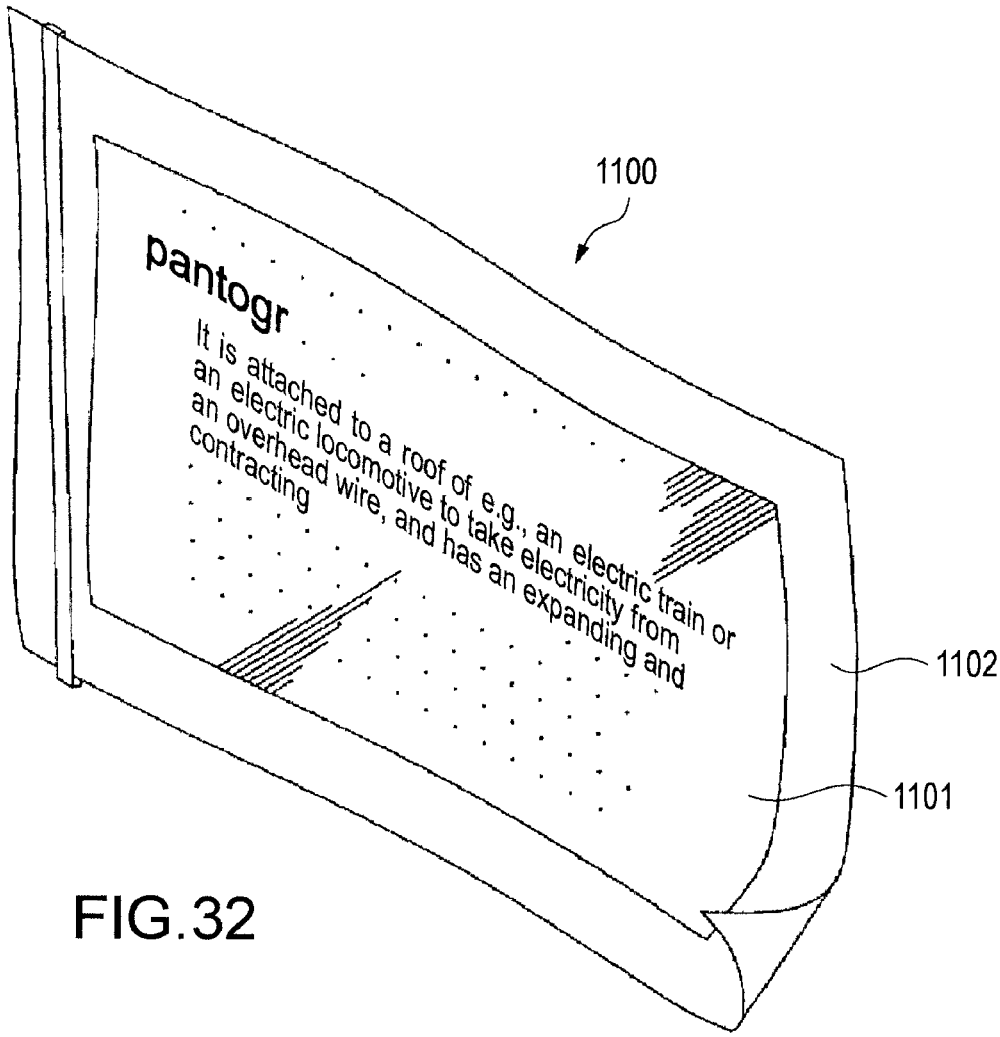
FIG. 32 is a perspective view showing the configuration of an electronic paper sheet as an electronic apparatus according to an embodiment of the invention.

FIG. 32 is a perspective view showing the configuration of an electronic paper sheet 1100. The electronic paper sheet 1100 includes the electrophoretic display device 100 (110) according to each of the above-described embodiments in a display area 1101. The electronic paper sheet 1100 has flexibility and is configured to include a main body 1102 formed of a re-writable sheet having the same texture and flexibility as those of a general paper sheet.

Figure 33:
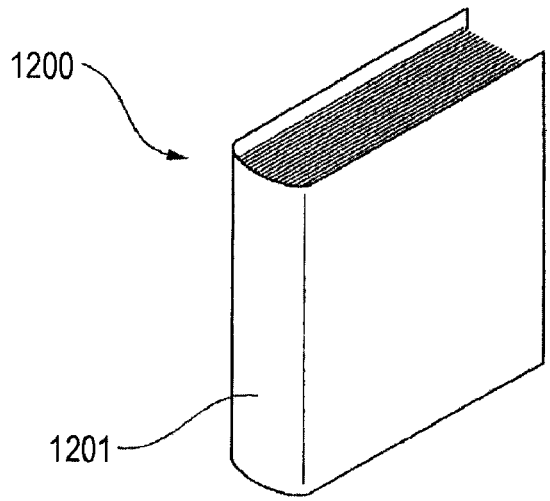
FIG. 33 is a perspective view showing the configuration of an electronic notebook as an electronic apparatus according to an embodiment of the invention.

FIG. 33 is a perspective view showing the configuration of an electronic notebook 1200. The electronic notebook 1200 is formed by binding a plurality of the electronic paper sheets 1100 shown in FIG. 32 and inserting the electronic paper sheets into a cover 1201. The cover 1201 includes a display data inputting unit that receives display data not shown in the figure, for example, transmitted from an external apparatus. Accordingly, the display content of the electronic paper sheets can be changed or updated in a state that the electronic paper sheets are bound in accordance with the display data.

According to the wrist watch 1000, the electronic paper sheet 1100, and the electronic notebook 1200, the electrophoretic display device according to an embodiment of the invention is used as a display unit. Accordingly, an electronic apparatus that can remove an image without generating an afterimage while suppressing the power consumption can be configured.

In addition, the electronic apparatuses shown in FIGS. 31 to 33 are examples of electronic apparatuses according to embodiments of the invention and do not limit the technical scope of the invention. For example, the electrophoretic display device according to an embodiment of the invention can be appropriately used in a display unit of an electronic apparatus such as a cellular phone, a mobile audio apparatus, or the like.

The entire disclosure of Japanese Patent Application Nos. 2008-287713, filed Nov. 10, 2008, 2008-287714, filed Nov. 10, 2008 and 2009-058068, filed Mar. 11, 2009 are expressly incorporated by reference herein.

What is claimed is:

1. A method of driving an electrophoretic display device including a display unit that has a plurality of pixels and an electrophoretic element disposed between substrates forming one pair, the method comprising:

displaying a second gray scale at first pixels in a first area of the display unit and second pixels in a second area of the display unit, the second area surrounding the first area;

selectively displaying a first gray scale at the first pixels in the first area of the display unit; and selectively displaying the second gray scale at pixels in an image removing area, the image removing area including the first pixels in the first area and a part of the second pixels that is disposed to be adjacent to the pixel forming the contour of the first area, wherein, during displaying the first gray scale at the first pixels in the first area of the display unit, an area which displays the first gray scale expands beyond the first area to the second area.

2. A method of driving an electrophoretic display device including a display unit that has a plurality of pixels and an electrophoretic element disposed between substrates forming one pair, the method comprising:

displaying a second gray scale at first pixels in a first area of the display unit and second pixels in a second area of the display unit, the second area surrounding the first area;

selectively displaying a first gray scale at the first pixels in the first area of the display unit;

selectively displaying the second gray scale at the first pixels in the first area; and selectively displaying the second gray scale at pixels in an afterimage removing area, the afterimage removing area including a part of the first pixels that forms the contour of the first are and a part of the second pixels that is disposed to be adjacent to the pixel that forms the contour of the first area, wherein, during displaying the first gray scale at the first pixels in the first area of the display unit, an area which displays the first gray scale expands beyond the first area to the second area.

3. The method according to claim 2, wherein, a value acquired by multiplying a voltage applied to the electrophoretic element by a time interval of application of the voltage during selectively displaying the second gray scale at the pixels in the afterimage removing area is set to be smaller than a value acquired by multiplying a voltage applied to the electrophoretic element and a time interval of application of the voltage during selectively displaying the second gray scale at the first pixels in the first area.

4. An electrophoretic display device comprising:

a display unit that includes a plurality of pixels and an electrophoretic element disposed between substrates forming one pair; and a control unit that controls the display unit;

wherein the control unit is configured to execute a method including:

displaying a second gray scale at first pixels in a first area of the display unit and second pixels in a second area of the display unit, the second area surrounding the first area;

selectively displaying a first gray scale at the first pixels in the first area of the display unit; and selectively displaying the second gray scale at pixels in an image removing area, the image removing area including the first pixels in the first area and a part of the second pixels that is disposed to be adjacent to the pixel forming the contour of the first area, wherein, during displaying the first gray scale at the first pixels in the first area of the display unit, an area which displays the first gray scale expands beyond the first area to the second area.

5. An electronic apparatus comprising the electrophoretic display device according to claim 4.

6. An electrophoretic display device comprising:

a display unit that includes a plurality of pixels and an electrophoretic element disposed between substrates forming one pair; and a control unit that controls the display unit;

wherein the control unit is configured to execute a method including:

displaying a second gray scale at first pixels in a first area of the display unit and second pixels in a second area of the display unit, the second area surrounding the first area;

selectively displaying a first gray scale at the first pixels in the first area of the display unit;

selectively displaying the second gray scale at the first pixels in the first area; and selectively displaying the second gray scale at pixels in an afterimage removing area, the afterimage removing area including a part of the first pixels that forms the contour of the first are and a part of the second pixels that is disposed to be adjacent to the pixel that forms the contour of the first area, wherein, during displaying the first gray scale at the first pixels in the first area of the display unit, an area which displays the first gray scale expands beyond the first area to the second area.

7. An electronic apparatus comprising the electrophoretic display device according to claim 6.

* * * * *